US010954623B2

(12) United States Patent
Son et al.

(10) Patent No.: US 10,954,623 B2
(45) Date of Patent: Mar. 23, 2021

(54) APPARATUS FOR TREATING LAUNDRY

(71) Applicant: LG ELECTRONICS INC., Seoul (KR)

(72) Inventors: Kuyoung Son, Seoul (KR); Keunjoo Kim, Seoul (KR); Hyeokdeok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 114 days.

(21) Appl. No.: 15/695,908

(22) Filed: Sep. 5, 2017

(65) Prior Publication Data

US 2018/0187361 A1 Jul. 5, 2018

(30) Foreign Application Priority Data

Jan. 3, 2017 (KR) ..... 10-2017-0000943

(51) Int. Cl.
*D06F 39/02* (2006.01)
*D06F 31/00* (2006.01)
(Continued)

(52) U.S. Cl.
CPC ..... *D06F 39/028* (2013.01); *D06F 21/06* (2013.01); *D06F 31/00* (2013.01); *D06F 37/26* (2013.01);
(Continued)

(58) Field of Classification Search
CPC ..... D06F 21/06; D06F 23/04; D06F 29/00; D06F 31/00; D06F 39/02; D06F 39/022; D06F 39/028; D06F 39/088
See application file for complete search history.

(56) References Cited

U.S. PATENT DOCUMENTS 3,088,304 A * 5/1963 Bochan ..... D06F 39/083 68/12.18
3,336,767 A * 8/1967 MacKenzie ..... D06F 39/022 68/12.15
(Continued)

FOREIGN PATENT DOCUMENTS

CN 1133368 10/1996
CN 104790168 7/2015
(Continued)

OTHER PUBLICATIONS

Machine Translation of Fei et al., CN 104790168, Jul. 2015. (Year: 2015).*
(Continued)

*Primary Examiner* — David G Cormier
(74) *Attorney, Agent, or Firm* — Fish & Richardson P.C.

(57) ABSTRACT

A laundry treating apparatus includes a housing, which includes first and second wash units within the housing. The first and second wash unit include first and second tubs, first and second drums mounted inside the first and second tubs, and first and second drive units configured to drive rotations of the first and second drums, respectively. The laundry treating apparatus also includes a valve assembly that is configured to receive tap water and that is configured to control a supply of the tap water to each of the first wash unit and the second wash unit within the housing. The laundry treating apparatus further includes at least two supply lines configured to supply the tap water from the valve assembly to at least two supply points of the second tub in the second wash unit.

24 Claims, 12 Drawing Sheets

(51) Int. Cl.

| | |
|---|---|
| ***D06F 39/08*** | (2006.01) |
| ***D06F 21/06*** | (2006.01) |
| ***D06F 37/26*** | (2006.01) |
| *D06F 29/00* | (2006.01) |
| *D06F 37/12* | (2006.01) |

(52) U.S. Cl.
CPC ..... *D06F 39/088* (2013.01); *D06F 29/00* (2013.01); *D06F 37/12* (2013.01)

(56) References Cited

U.S. PATENT DOCUMENTS

| | | | | |
|---|---|---|---|---|
| 4,986,093 | A * | 1/1991 | Pastryk | D06F 39/02 68/13 R |
| 7,784,310 | B1 * | 8/2010 | Bradford | D06F 33/02 68/12.18 |
| 2011/0154865 | A1 * | 6/2011 | Lee | D06F 39/02 68/200 |
| 2013/0117943 | A1 | 5/2013 | Kim | |
| 2018/0179692 | A1 * | 6/2018 | Jo | D06F 21/02 |

FOREIGN PATENT DOCUMENTS

| | | | |
|---|---|---|---|
| CN | 106149276 | | 11/2016 |
| EP | 2980299 | A1 | 2/2016 |
| JP | 08229293 | | 9/1996 |
| KR | 10-1997-0006630 | | 2/1997 |
| KR | 10-2010-0004728 | | 1/2010 |
| KR | 10-2011-0004747 | | 1/2011 |
| KR | 10-2015-0072169 | | 6/2015 |
| RU | 2421558 | | 6/2011 |
| RU | 2563768 | | 9/2015 |
| WO | WO2008084933 | A1 | 7/2008 |
| WO | 2018/117526 | | 6/2018 |

OTHER PUBLICATIONS

International Search Report and Written Opinion in International Application No. PCT/KR2017/007747, dated Oct. 24, 2017, 13 pages (with English translation).
European Office Action in European Appln. No. 17189893.5, dated Jan. 21, 2019, 4 pages.
Extended European Search Report in European Application No. 17189893.5, dated Feb. 26, 2018, 11 pages.
Office Action in China Patent Application No. 201710665307.7, dated Oct. 12, 2019, 17 pages (with English translation).
Extended European Search Report in European Application No. 19209209.6, dated Feb. 26, 2020, 12 pages.
Russian Office Action in Russian Application No. 2019122171/12, dated Sep. 14, 2020, 12 pages (with English translation).

* cited by examiner

FIG. 12

| | Washing | Rinsing | Dewatering |
|---|---|---|---|
| Second valve assembly (second detergent water supply line) | ON | ON | OFF |
| Detergent water supply valve (second auxiliary detergent water supply line) | ON | ON | OFF |
| Second valve assembly (second auxiliary detergent water supply line) | OFF | ON | OFF |
| Auxiliary detergent water supply valve (auxiliary detergent water supply pipe) | OFF | ON | OFF |

APPARATUS FOR TREATING LAUNDRY

This application claims the benefit of Korean Application No. 10-2017-0000943, filed on Jan. 3, 2017, which is hereby incorporated by reference as if fully set forth herein.

TECHNICAL FIELD

The present disclosure relates to an apparatus for treating laundry, and more particularly, to a twin washer.

BACKGROUND

In general, laundry treatment apparatuses are appliances for washing laundry using detergent and mechanical friction.

Generally, a laundry treating device is a device capable of washing, drying, or washing and drying laundry and the like. Herein, the laundry treating device may perform a wash or dry function only, or may perform both of the wash and dry functions. Recently, a steam supplier equipped washer having a refresh function (e.g., wrinkle press-out, deodorization, static electricity removal, etc.) for laundry have come into wide use.

Laundry treating devices are typically categorized into a front load type or a top load type according to a withdrawal direction of laundry. Moreover, there is a vertical axis type having a pulsator or wash tub rotated therein or a horizontal type having a drum rotated according to a wash performed scheme.

A representative example of the horizontal type is a drum washer or a drum dryer. Hereinafter, a laundry treating device of a front type is defined as a laundry treating device including an opening provided to a front side and a drum of which rotation axis is in parallel with a ground surface or has a predetermined inclination. A laundry treating device of a top load type is defined as a laundry treating device including an opening provided to a top and a drum of which rotation axis is vertical to a ground surface.

Generally, each home uses a single laundry treating device of large capacity. In some situations, the laundry treating device is used several times to wash laundries according to their categories. For instance, in case of intending to separately wash the laundry such as adult clothes and the laundry such as underwear, baby clothes and the like, after the wash of the former has been completed, the laundry treating device used again to wash the latter.

SUMMARY

In one aspect, a laundry treating apparatus may include a housing; and a first wash unit within the housing, the first wash unit including a first tub, a first drum mounted inside the first tub, and a first drive unit configured to drive a rotation of the first drum within the first tub. The laundry treating apparatus may also include a second wash unit within the housing, the second wash unit including a second tub, a second drum mounted inside the second tub, and a second drive unit configured to drive a rotation of the second drum within the second tub. The laundry treating apparatus may also include a valve assembly that is configured to receive tap water and that is configured to control a supply of the tap water to each of the first wash unit and the second wash unit within the housing. The laundry treating apparatus may further include at least two supply lines configured to supply the tap water from the valve assembly to at least two supply points of the second tub in the second wash unit.

In some implementations, the at least two supply lines may include: a detergent water supply line configured to supply, to the second tub, a detergent water including a detergent; and a tap water supply line configured to supply, to the second tub, tap water without detergent.

In some implementations, the second wash unit may be a top loading type, and the second tub may include: a top portion defining an upward opening through which an inside of the second tub is accessible; a bottom portion fixing the second drive unit and having a perforated hole connecting the second drum and the second drive unit to each other; and a sidewall connecting the top portion and the bottom portion in a cylindrical shape. A diameter of the bottom portion of the second tub may be greater than a height of the sidewall of the second tub.

In some implementations, the detergent water supply line may be configured to supply the detergent water through the sidewall of the second tub, and the tap water supply line may be configured to supply the tap water through the opening of the top portion of the second tub.

In some implementations, the at least two supply lines may include a detergent water supply line and a tap water supply line, the detergent water supply line including a plurality of diverging lines.

In some implementations, the at least two supply lines may include a detergent water supply line and a tap water supply line, the detergent water supply line including a detergent water supply line that passes through a detergent storage part and an auxiliary detergent water supply line that passes through an auxiliary detergent storage part.

In some implementations, the at least two supply lines may include a detergent water supply line that includes a detergent water supply pipe configured to pass through a detergent storage part that is located between the housing and the second tub, and connect the detergent storage part to a sidewall of the second tub.

In some implementations, the at least two supply lines may include a plurality of detergent water supply lines. A first detergent water supply line may pass through a detergent storage part located between the housing and the second tub to supply a detergent water to the second tub. A second detergent water supply line may pass through an auxiliary detergent storage part located between the housing and the second tub to supply an auxiliary detergent water to the second tub.

In some implementations, the at least two supply lines may include a plurality of detergent water supply lines. A first detergent water supply line may pass through a detergent storage part located between the housing and the second tub. A second detergent water supply line may pass through an auxiliary detergent storage part located between the housing and the second tub. The at least two supply lines may further include: a detergent water supply pipe connecting the detergent storage part and a sidewall of the second tub; and an auxiliary detergent water supply pipe connecting the auxiliary detergent storage part and the sidewall of the second tub.

In some implementations, the at least two supply lines may include a plurality of detergent water supply lines. The plurality of the detergent water supply lines may be connected and distributed to the at least two supply points of the second tub. A detergent storage part may be located on each of the plurality of detergent water supply lines. The detergent storage part may be located between an outside of the second tub and the housing, and a detergent water supply pipe may be provided between the detergent storage part and the second tub.

In some implementations, the laundry treating apparatus may further include a detergent water supply valve located at the detergent water supply pipe between the detergent storage part and the second tub.

In some implementations, the detergent water supply valve may include a check valve configured to control a unidirectional flow of detergent water toward the second tub.

In some implementations, the detergent water supply valve may include an electronic valve configured to be controlled to interoperate with the valve assembly by at least one processor.

In some implementations, during supply of tap water, the detergent water supply valve may be turned on and control a supply of detergent water to the second tub through the detergent water supply pipe. Based on a washing, rinsing, or dewatering cycle being in progress through the detergent water supply pipe in a state that a supply of tap water is stopped, the detergent water supply valve may be turned off to block the wash water in the second tub from flowing backward to the detergent storage part through the detergent water supply pipe.

In some implementations, the detergent water supply pipe may be configured to communicate with an inside of the second tub by perforating a sidewall of the second tub. Each of the plurality of detergent water supply pipes may be connected at a different location on the sidewall of the second tub.

In some implementations, a plurality of the detergent water supply lines may be configured in a manner in which a connection to the second tub is distributed into several points. A location of each of the detergent water supply lines connected to the second tub may be connected to have a difference in elevation.

In some implementations, each of the detergent water supply pipes may be provided to a sidewall of the second tub. A location of one of the detergent water supply pipes may communicate with the sidewall at a location relatively higher than that of another one of the detergent water supply pipes.

In some implementations, the at least two supply lines may include a tap water supply line and a detergent water supply line. The detergent water supply line may include a plurality of supply lines configured to separately supply a detergent and a fabric softener.

In some implementations, the detergent water supply line may include a bleach line configured to supply bleach.

In some implementations, the detergent water supply line may pass through a detergent storage part configured to supply detergent and an auxiliary detergent storage part configured to supply fabric softener.

In some implementations, the auxiliary detergent storage part may include a plurality of auxiliary detergent storage parts configured to supply bleach.

In some implementations, the at least two supply lines may include a tap water supply line and a detergent water supply line. The detergent water supply line may include a plurality of supply lines to separately supply detergent and fabric softener, and an auxiliary detergent storage part configured to store the fabric softener, further including an electronic valve that is configured to cut off the tap water and that is located at a front end of the auxiliary detergent storage part on a line diverging to the auxiliary detergent storage part from the detergent water supply line.

In some implementations, the electronic valve may be controlled to be turned on for a portion of a time needed to control the valve assembly to be turned on so that the tap water supplies the fabric softener to the second tub through the auxiliary detergent storage part.

In some implementations, while the electronic valve is controlled to be turned on, a water supply valve on an auxiliary detergent water supply pipeline between the auxiliary detergent storage part and the second tub may be controlled to be turned on.

In some implementations, the water supply valve on the auxiliary detergent water supply pipeline may include a check valve. Based on the electronic valve being turned on, the water supply valve may be open by a flow pressure so that the fabric softener is supplied into the second tub.

In some implementations, the at least two supply lines may include a tap water supply line and a detergent water supply line. The tap water supply line may be configured to supply the tap water through the opening of the top portion of the second tub.

In some implementations, the tap water supply line may be configured to be turned off by a control of the valve assembly. The tap water supply line may be configured to supply the tap water toward the opening of the top portion of the second tub from the valve assembly. The tap water supply line may be configured to connect a sidewall of the second tub to the valve assembly and supply detergent water via a detergent storage part.

In some implementations, the tap water supply line may be configured to be turned off by a control of the valve assembly. The tap water supply line may be configured to supply the tap water toward the opening of the top portion of the second tub from the valve assembly. The tap water supply line may diverge to connect to a sidewall of the second tub and supply detergent water via a detergent storage part.

In some implementations, the at least two supply lines may include a tap water supply line and a plurality of detergent water supply lines. The tap water supply line may be configured to supply the tap water through the opening of the top portion of the second tub. The plurality of detergent water supply lines may diverge between the valve assembly and the tap water supply line, connect to a plurality of points on a sidewall of the second tub, respectively, and separately supply a detergent and a fabric softener.

Further scope of applicability of the present disclosure will become apparent from the detailed description given hereinafter. However, it should be understood that the detailed description and specific examples, while indicating preferred implementations of the disclosure, are given by illustration only, since various changes and modifications within the spirit and scope of the disclosure will become apparent to those skilled in the art from this detailed description.

BRIEF DESCRIPTION OF THE DRAWINGS

FIG. 12 is a table showing an example operation of each valve in response to an operation of a second wash unit in a laundry treating apparatus according to the present disclosure.

DETAILED DESCRIPTION

Figure 1:
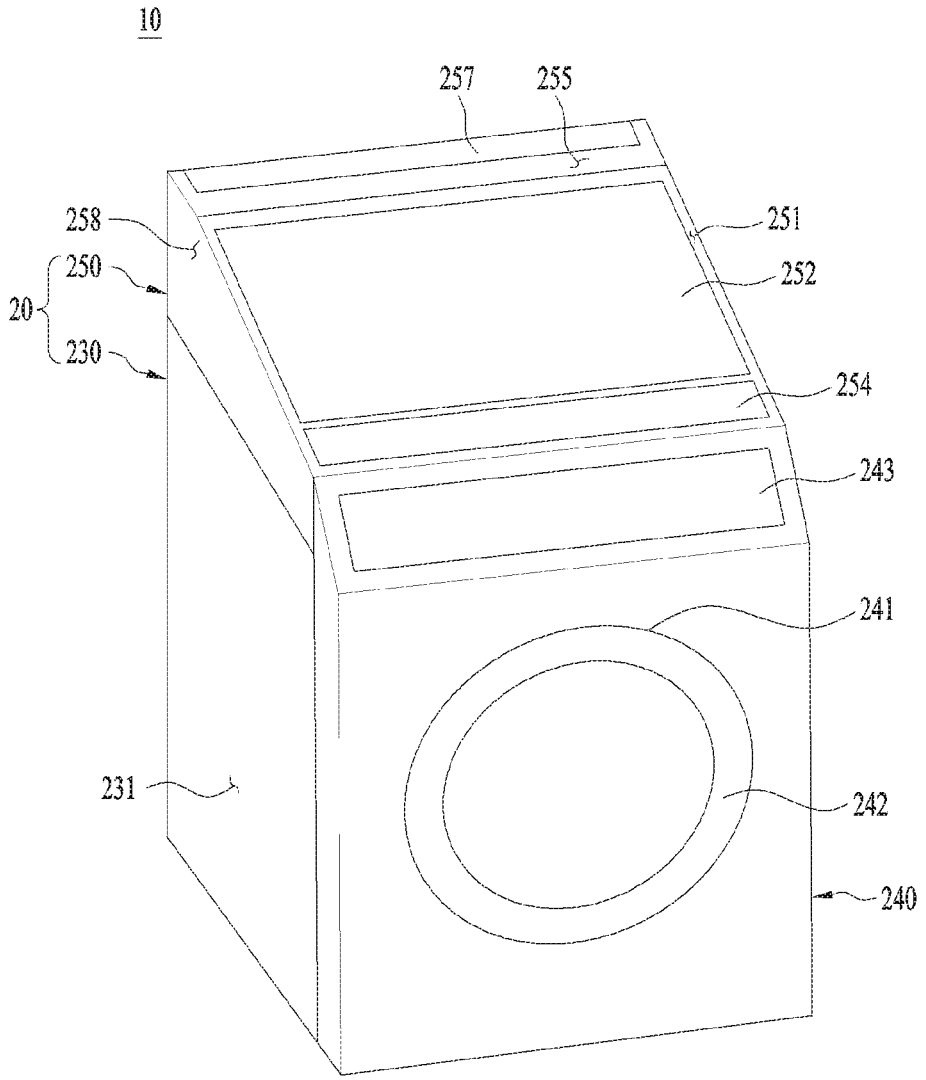
FIG. 1 is a perspective view illustrating an example laundry treating apparatus according to the present disclosure.

Implementations described herein provide a laundry treating apparatus that variously controls a supply of water to first and second washing units provided in the laundry treating apparatus.

One object of the present disclosure is to provide a laundry treating apparatus, i.e., a twin washer, by which a small quantity of laundry or laundry (e.g., underwear, baby clothing) necessary to be washed by being separated from normal laundry and a large quantity of laundry can be separately washed in a single washer.

Another object of the present disclosure is to provide a laundry treating apparatus, by which a user can selectively wash or dry various kinds of laundry in a manner of providing a front loading type washer and a top loading type washer having capacity relatively smaller than that of the front loading type washer are provided to a top and bottom of the apparatus, respectively.

Another object of the present disclosure is to provide a laundry treating apparatus capable of separately washing laundry, by which a wash time of a second washer of a top loading type provided to a top with a relatively small capacity can be reduced.

Another object of the present disclosure is to provide a laundry treating apparatus having a second washer of a top loading type, by which user's convenience and wash performance can be enhanced in a manner of enabling a detergent supply.

Another object of the present disclosure is to provide a laundry treating apparatus capable of separate wash by having a second washer of a top loading type, by which wash water can be prevented from flowing backward in the cycle of a wash if a diameter of the second washer is relatively greater than a height of the tub.

Further object of the present disclosure is to provide a laundry treating apparatus capable of separate wash by having a second washer of a top loading type, by which tap water and detergent water can be smoothly supplied and by which the supply of the tap water and the detergent water can be controlled to prevent the wash water supplied into a tub from flowing backward or jetting out of a tub.

Technical tasks obtainable from the present disclosure are non-limited by the above-mentioned technical tasks. Other unmentioned technical tasks can be clearly understood from the following description by those having ordinary skill in the technical field to which the present disclosure pertains.

Additional advantages, objects, and features of the disclosure will be set forth in the disclosure herein as well as the accompanying drawings. Such aspects may also be appreciated by those skilled in the art based on the disclosure herein.

To achieve these objects and other advantages and in accordance with the purpose of the disclosure, as embodied and broadly described herein, an apparatus for treating laundry according to one implementation of the present disclosure includes a housing, a first wash unit having a first tub, a first drum and a first drive unit within the housing, a second wash unit having a second tub, a second drum and a second drive unit within the housing, an external supply line connected to the housing externally to supply a tap water, a valve assembly controlling a tap water supply to each of the first and second wash units within the housing from the external supply line, and a second supply line supplying the tap water to the second wash unit from the valve assembly, the second supply line including a tap water supply line and a detergent water supply line to enable a wash water to be distributively supplied to several points of the second tub.

According to one implementation of the present disclosure, the second supply line includes a detergent water supply line supplying a detergent water containing a detergent to the second tub and a tap water supply line supplying the tap water not containing the detergent to the second tub.

According to one implementation of the present disclosure, the second wash unit is a top loading type, the second tub includes a top portion including an opening open upward to enable the laundry to be inserted, a bottom portion fixing the second drive unit and having a perforated hole connecting the second drum and the second drive unit to each other, and a sidewall connecting the top portion and the bottom portion in a cylindrical shape, a diameter of the bottom portion of the second tub is greater than a height of the sidewall, the detergent water supply line is configured to supply the detergent water through the sidewall of the second tub, and the tap water supply line is configured to supply the tap water through the opening of the top portion of the second tub.

According to another implementation of the present disclosure, the second supply line supplying the wash water to the second wash unit is connected to several points of the second tub by diverging plurally and includes a detergent water supply line and a tap water supply line.

According to the above implementation, the tap water supply line is extended from the valve assembly formed housing toward the top portion of the second tub and supplies the tap water through the top portion of the second tub.

According to the above implementation, the detergent water supply line of the second supply line is connected to a sidewall of the second tub via a detergent storage part. Herein, the detergent water supply line includes a detergent supply pipe between the second tub and the housing to connect the detergent storage part and the sidewall of the second tub.

The detergent water supply pipe is configured in a rubber bellows shape.

According to the above implementation, the detergent water supply pipe is connected to a lateral side of the second tub at a location opposite to the valve assembly formed housing.

The detergent water supply pipe is located at a lateral side of the second tub on an extension line of the tap water supply line.

According to another implementation of the present disclosure, the detergent water supply pipe is located between the housing and the second tub in a region deviating from the extension line of the tap water supply line.

The detergent water supply pipe is located above the center of the second tub in a height direction of the second tub.

According to another implementation of the present disclosure, the second supply line supplying the wash water to the second wash unit includes a detergent water supply line and a tap water supply line and the detergent water supply line includes a plurality of diverging lines.

According to the above implementation, the second tub of the second wash unit includes a sidewall in a cylindrical shape, a top portion having an opening formed therein, and a bottom portion having a second drive unit fixed thereto, and a diameter of the bottom portion is formed greater than a height of the sidewall.

According to one implementation of the present disclosure, the second supply line includes a detergent water supply line and a tap water supply line and the detergent water supply line includes a detergent water supply line passing through a detergent storage part storing the detergent and an auxiliary detergent water supply line passing through an auxiliary detergent storage part.

According to another implementation of the present disclosure, the second supply line includes a detergent water supply line and the detergent water supply line includes a detergent water supply pipe configured to pass through a detergent storage part formed between the housing and the second tub and connect the detergent storage part to a sidewall of the second tub.

According to further implementation of the present disclosure, the second supply line includes a plurality of detergent water supply lines, one of a plurality of the detergent water supply lines passes through a detergent storage part formed between the housing and the second tub to supply the detergent water to the second tub, and the other one passes through an auxiliary detergent storage part formed between the housing and the second tub to supply the detergent water to the second tub.

According to further implementation of the present disclosure, the second supply line includes a plurality of detergent water supply lines, one of a plurality of the detergent water supply lines passes through a detergent storage part formed between the housing and the second tub, the other one passes through an auxiliary detergent storage part formed between the housing and the second tub, and the second supply line includes a detergent water supply pipe connecting the detergent storage part and a sidewall of the second tub and an auxiliary detergent water supply pipe connecting the auxiliary detergent storage part and the sidewall of the second tub.

According to further implementation of the present disclosure, the second supply line includes a plurality of detergent water supply lines, a plurality of the detergent water supply lines are connected by being distributed to several points of the second tub, a detergent storage part is formed on each of the detergent water supply lines, the detergent storage part is configured to be located between an outside of the second tub and the housing, and a detergent water supply pipe is provided between the detergent storage part and the second tub.

A detergent water supply valve is provided to the detergent water supply pipe between the detergent storage part and the second tub.

The detergent water supply valve includes a check valve enabling the detergent water to flow in a direction toward the second tub only.

The detergent water supply valve includes an electronic valve so as to be controlled to interoperate with the valve assembly by a controller.

While the tap water is supplied, the detergent water supply valve is turned on so as to enable the detergent water to be supplied to the second tub through the detergent water supply pipe. Yet, if a washing, rinsing or dewatering cycle is in progress through the detergent water supply pipe in a state that a supply of the tap water is stopped, the detergent water supply valve is turned off so as to prevent the wash water in the second tub from flowing backward to the detergent storage part through the detergent water supply pipe.

A plurality of the detergent water supply pipes are configured to communicate with an inside of the second tub by perforating a sidewall of the second tub and each of the detergent water supply pipes is connected at a different location on the sidewall of the second tub.

According to the above implementation, a plurality of the detergent water supply pipes are connected to the sidewall of the second tub at a location opposite to the valve assembly formed housing.

A plurality of the detergent water supply pipes is formed at the second tub sidewall on an extension line of the tap water supply line located at the top portion of the second tub or a location of the sidewall adjacent to the extension line.

A plurality of the detergent water supply pipes are co-located in a height direction of the second tub or configured to have an overlapping region.

According to another implementation of the present disclosure, a plurality of the detergent water supply pipes are located on an edge between the second tub and the housing deviating from the extension line of the tap water supply line.

Herein, the detergent water supply pipe is located on the edge between the second tub and the housing on each of a left side and a right side of a front side of the housing.

The detergent water supply pipe is formed at the same location in a height direction of the second tub.

A plurality of the detergent water supply lines are configured in a manner that the connected point to the second tub is distributed into several points and a location of each of the detergent water supply lines connected to the second tub is connected to have an altitude difference.

A plurality of the detergent water supply pipes are configured to communicate with a sidewall of the second tub and a location of one of the detergent water supply pipes communicates with the sidewall at a location relatively higher than that of another one of the detergent water supply pipes.

One of a plurality of the detergent water supply pipes is located at a top end of the sidewall of the second tub and the other is located below the former.

The detergent water supply pipe located below among the detergent water supply pipes is located in a middle or lower part for the height direction of the second tub.

The detergent water supply pipe located at a most upper part among the detergent water supply pipes is located higher than the middle part for the height direction of the second tub and the rest of the detergent water supply pipes are located below the middle part.

The detergent water supply pipe located at a most upper part among the detergent water supply pipes is located at the middle part for the height direction of the second tub and the rest of the detergent water supply pipes are located below the middle part.

According to further implementation of the present disclosure, the second supply line includes a tap water supply line and a detergent water supply line and the detergent water supply line includes a plurality of supply lines to supply a detergent and a fabric softener, respectively.

The detergent water supply line further includes a line for supplying a material functioning differently from the detergent or the fabric softener like a bleach.

The detergent water supply line is configured to pass through a detergent storage part for supplying the detergent and an auxiliary detergent storage part for supplying the fabric softener.

The auxiliary detergent storage part includes a plurality of auxiliary detergent storage parts to supply a material functioning differently from the fabric softener like a bleach.

According to further implementation of the present disclosure, the second supply line includes a tap water supply line and a detergent water supply line, the detergent water supply line includes a plurality of supply lines to supply a detergent and a fabric softener, respectively and an auxiliary detergent storage part storing the fabric softener, and an electronic valve configured to cut off the supplied tap water is further provided to a front end of the auxiliary detergent storage part on a line diverging to the auxiliary detergent storage part from the detergent water supply line.

The electronic valve configured to cut off the tap water supply to the auxiliary detergent storage part is controlled to be turned on for a portion of a time for controlling the valve assembly to be turned on so that the tap water supplies the fabric softener to the second tub through the auxiliary detergent storage part.

While the electronic valve provided to the front end of the auxiliary detergent storage part is controlled to be turned on, a water supply valve on an auxiliary detergent water supply pipeline between the auxiliary detergent storage part and the second tub is controlled to be turned on.

The water supply valve on the auxiliary detergent water supply pipeline includes a check valve. If the electronic valve provided to the front end of the auxiliary detergent storage part is controlled to be turned on, the water supply valve is open by a flow pressure so that the fabric softener is supplied into the second tub.

According to further implementation of the present disclosure, the second supply line includes a tap water supply line and a detergent water supply line and the tap water supply line supplies the tap water through the opening of the top portion of the second tub.

The second supply line includes a tap water supply line configured to be controlled to cut off the line by a control of the valve assembly and supply the tap water toward the opening of the top portion of the second tub from the valve assembly and a tap water supply line configured to connect a sidewall of the second tub from the valve assembly and supply the detergent water via a detergent storage part.

The second supply line includes a tap water supply line configured to be controlled to cut off the line by a control of the valve assembly and supply the tap water toward the opening of the top portion of the second tub from the valve assembly and a tap water supply line configured to connect a sidewall of the second tub by diverging between the valve assembly the tap water supply line and supply the detergent water via a detergent storage part.

A plurality of the detergent water supply lines may diverge between the valve assembly and the tap water supply line, connect to a plurality of points on a sidewall of the second tub, respectively, and separately supply a detergent and a fabric softener.

According to further implementation of the present disclosure, the present disclosure, the present disclosure includes a housing, a first wash unit having a first tub, a first drum and a first drive unit within the housing, a second wash unit having a second tub, a second drum and a second drive unit within the housing, an external supply line connected to the housing externally to supply a tap water, a valve assembly controlling a tap water supply to each of the first and second wash units within the housing from the external supply line, a second supply line supplying the tap water to the second wash unit from the valve assembly, and a first supply line supplying the tap water to the first wash unit from the valve assembly, the second supply line includes a tap water supply line and a detergent water supply line to enable a wash water to be distributively supplied to several points of the second tub, the second wash unit is located above the first wash unit, the second tub includes a top portion including an opening, a bottom portion supporting the second drive unit, and a sidewall connecting the top portion and the bottom portion in a cylindrical shape, a detergent storage part is formed between the housing and the second tub to be located on the detergent water supply line, a detergent supply pipe connecting the detergent storage part and the second tub sidewall is included, a tub case including a tub cover configured to open/close the opening is provided to the top portion of the second tub, a housing opening is formed in a top portion of the housing to communicate with the second tub through the tub case, and a housing cover configured to open/close the housing opening is included in the top portion of the housing.

According to the above implementation, the tub case includes a body part having a hinge part supporting the tub cover.

A tap water supply line of the second supply line is connected to a top end of the body part of the tub case facing the housing cover.

An opening is formed in the top end of the body part of the tub case and the tap water supply line of the second supply pipe communicates with an inside of the second tub by perforating the opening.

The body part of the tub case is configured in a dual structure including a top body part and a bottom body part and the tap water supply line of the second supply line is configured to supply the tap water between the top and bottom body parts through the opening formed in the top body part.

The bottom body part of the tub case faces the inside of the second tub and enables the tap water, which is supplied through the top body part by forming a plurality of openings, to be supplied to the inside of the second tub through the opening.

The opening of the bottom body part is arranged in a plurality of columns so as to enable the supplied tap water to be supplied widely through the second tub top opening.

The detergent storage part is located at a front left or right side of the housing.

The detergent storage part is plurally located each of the front left and right sides of the housing, a detergent is stored in one of the left and right sides, and a fabric softener is stored in the other.

A detergent supply pipe enabling the detergent storage part and the second tub sidewall to communicate with each other on the detergent water supply line of the second supply line corresponds to the detergent storage part and is configured plurally according to the number of the detergent storage parts.

A plurality of the detergent supply pipes are connected to have different heights of the sidewall of the second tub.

The first supply line further includes a first wash unit detergent storage part for the supply to the first tub between the housing and the second tub.

The first supply line further includes a first wash unit detergent supply pipe to enable the first wash unit detergent storage part and the first tub to communicate with each other.

The detergent storage part communicating with the detergent water supply line of the second supply line and the first wash unit detergent storage part communicating with the first supply line are located between the housing and the tub and also located on a front side of the top of the housing.

The first wash unit detergent storage part has a plurality of detergent entrances between the left and right sides of the housing front.

As to the laundry treating apparatus, the first wash unit detergent storage part further includes a detergent cover for opening/closing, a front of the detergent cover corresponds to the front of the housing, a rear of the detergent cover is disposed adjacent to one side end of the tub case.

The detergent supply part for supplying the detergent into the second tub is disposed adjacent to the first wash unit detergent storage part and located a housing edge between the housing and the second tub.

The laundry treating apparatus further includes a supply valve on the detergent supply pipeline.

The laundry treating apparatus includes a supply valve on a detergent supply pipeline configuring a detergent water supply line of the second supply line between the second tub and the detergent storage part and a separate supply valve is not configured between the first wash unit detergent storage part of the first supply line and the first tub.

The supply valve includes a check valve capable of a flow in a direction of the second tub only or an electronic valve capable of on/off control.

The electronic valve is characterized in interoperating with a control of the valve assembly for supplying or cutting off the tap water into the second tub. In other words, if the valve assembly is turned on (open), the electronic valve is controlled to be turned on (open).

In another aspect of the present disclosure, as embodied and broadly described herein, a laundry treating apparatus according to one implementation of the present disclosure may include a first wash unit, a second wash unit located above the first wash unit, a frame supporting the first wash unit and the second wash unit, an outer panel forming an outer lateral side of the first wash unit by being joined to the frame, a tub case forming an exterior of the second wash unit by being seated on a top side of the first wash unit, and a front panel forming a front side of the second wash unit and the first wash unit by being joined to a front side of the frame.

The first wash unit is a washer of a front loading type and the second wash unit is a washer of a top loading type.

The first wash unit includes a tub having a tub entrance for inserting laundry through the front of the front panel and a drum having a drum entrance for inserting laundry through the front of the front panel to correspond to the tub entrance.

The second wash unit includes a tub having a tub entrance for inserting laundry through a top side of the tub case and a drum having a drum entrance for inserting laundry through the top side of the tub case to correspond to the tub entrance.

The frame includes a bottom frame configured to support the first wash unit and be joined to the outer panel and a top frame configured to support the second wash unit by being joined to a top side of the bottom frame and have the tub case seated and joined thereto.

The bottom frame includes at least two bottom vertical frames configured to be joined to the outer panel and a bottom horizontal frame configured to be joined to a top side of the outer panel and connect a top side of the bottom vertical frame.

The top frame includes at least two top vertical frames joined to the top side of the bottom horizontal frame and a top horizontal frame configured to support the tub case and connect the top side of the top vertical frame.

The first wash unit is supported by the bottom frame and the second wash unit is supported by the top frame.

The tube case includes an insertion entrance formed on a top surface for inserting laundry into the second wash unit and a detergent insertion entrance for supplying detergent species to the second wash unit.

The tub case includes a door for shielding the insertion entrance and a detergent insertion door for shielding the detergent insertion entrance.

The tub case includes a door for shielding both of the insertion entrance and the detergent insertion entrance simultaneously.

The tub case includes a service hole for exposing a controller for controlling the second wash unit and the first wash unit and a service cover detachably attached to the service hole.

A service hole for exposing a controller for controlling the second wash unit and the first wash unit and a service cover detachably attached to the service hole so as to open/close the service hole are provided to the rear of the tub case.

The tub case includes a detergent supply part having a detergent insertion part for inserting a detergent on one front side, a detergent storage part for temporarily storing the detergent inserted in the detergent insertion part, a detergent water supply pipe forming a flow path for guiding the detergent stored in the detergent storage part to the second wash unit, and an insertion valve for supplying the detergent by opening the detergent water supply pipe.

The second wash unit includes a water supply part for supplying the wash water, the water supply part supplies the wash water to the detergent storage part, and the detergent stored in the detergent storage part is mixed with the wash water and then supplied to the second wash unit by the detergent water supply valve.

The detergent water supply valve maintains a state of closing the detergent water supply pipe to prevent the wash water supplied to the second wash unit from flowing backward to the detergent storage part.

The tub case includes an auxiliary detergent supply part having an auxiliary detergent insertion part for inserting an auxiliary detergent on the other front side, an auxiliary detergent storage part for temporarily storing the auxiliary detergent inserted in the auxiliary detergent insertion part, an auxiliary detergent water supply pipe forming a flow path for guiding the auxiliary detergent stored in the auxiliary detergent storage part to the second wash unit, and a supply valve for supplying the auxiliary detergent by opening the auxiliary detergent water supply pipe.

The auxiliary storage part includes a connecting pipe connected to the detergent storage part and the auxiliary detergent stored in the auxiliary detergent storage part is supplied to the second wash unit by the auxiliary detergent water supply valve in a manner of being mixed with the wash water supplied from the detergent storage part through the connecting pipe.

A service hole for exposing the water supply part and a service cover detachably attached to the service hole so as to open/close the service hole are provided to the rear of the tub case.

In another aspect of the present disclosure, as embodied and broadly described herein, a laundry treating apparatus according to one implementation of the present disclosure may include a first wash unit having a first tub and a first drum, a second wash unit having a second tub and a second drum, the second wash unit located above the first wash unit, a water supply part supplying wash water to the first tub and the second tub by being provided to the second wash unit, and a detergent supply part supplying a detergent and an auxiliary detergent to the second tub by the wash water supplied by the water supply part, the detergent supply part includes a detergent insertion part provided to one front side of the second tub, a detergent storage part for temporarily storing the detergent inserted in the detergent insertion part, a detergent water supply pipe forming a flow path for guiding the detergent stored in the detergent storage part to the second wash unit, and a detergent water supply valve for supplying the detergent by opening the detergent water supply pipe, and the water supply part includes a valve assembly provided to one rear side of the second tub so as to control the supply of the wash water and a water supply pipe guiding the wash water supplied by the valve assembly to the detergent storage part. An auxiliary detergent supply part for supplying an auxiliary detergent to the second tub by the wash water supplied from the detergent supply part is further provided to the other side of the second tub.

The auxiliary detergent supply part includes an auxiliary detergent insertion part provided on the other front side of the second tub, an auxiliary detergent storage part for temporarily storing the auxiliary detergent inserted in the auxiliary detergent insertion part, a connecting pipe for guiding the wash water supplied to the detergent storage part to the auxiliary detergent storage part, an auxiliary detergent water supply pipe forming a flow path for guiding the auxiliary detergent stored in the auxiliary detergent storage part to the second tub, and an auxiliary detergent water supply valve for supplying the auxiliary detergent by opening the auxiliary detergent water supply pipe.

An auxiliary detergent supply part for supplying the auxiliary detergent to the second tub by the wash water supplied from the water supply part is further provided to the other side of the second tub.

The water supply part further includes an auxiliary detergent water supply pipe for supplying wash water to the auxiliary detergent supply part, and the auxiliary detergent supply part includes an auxiliary detergent insertion part provided on the other front side of the second tub, an auxiliary detergent storage part connected to the auxiliary detergent water supply pipe so as to temporarily store the auxiliary detergent inserted in the auxiliary detergent insertion part, an auxiliary detergent water supply pipe forming a flow path for guiding the auxiliary detergent stored in the auxiliary detergent storage part to the second tub, and an auxiliary detergent water supply valve for supplying the auxiliary detergent by opening the auxiliary detergent water supply pipe.

The water supply part further includes a second tap water supply line for supplying wash water to the second tub.

The water supply pipe includes a second tap water supply line for supplying wash water to the second tub and a detergent part water supply pipe for guiding the wash water to the detergent supply part by diverging from the water supply pipe.

An auxiliary detergent supply part for supplying an auxiliary detergent to the second tub is provided to the other side of the second tub and the water supply pipe further includes an auxiliary detergent part water supply pipe for guiding the wash water to the auxiliary detergent supply part by diverging from the water supply pipe.

The water supply pipe further includes a first valve assembly for controlling flow paths of the second tap water supply line, the detergent part water supply pipe and the auxiliary detergent part water supply pipe.

The auxiliary detergent supply part includes an auxiliary detergent insertion part provided on the other front side of the second tub, an auxiliary detergent storage part connected to the auxiliary detergent part water supply pipe so as to temporarily storing the auxiliary detergent inserted in the auxiliary detergent insertion part, an auxiliary detergent water supply pipe forming a flow path for guiding the auxiliary detergent stored in the auxiliary detergent storage part to the second tub, and an auxiliary detergent water supply valve for supplying the auxiliary detergent by opening the auxiliary detergent water supply pipe.

The auxiliary detergent part water supply pipe further includes an auxiliary detergent water supply valve for controlling the wash water supplied to the auxiliary detergent storage part.

The first wash unit includes a first detergent supply part for supplying a detergent and an auxiliary detergent to the first tub and the valve assembly further includes a first supply line for supplying the wash water to the first detergent supply part.

Accordingly, implementations of the present disclosure provide various effects and/or features.

According to the present disclosure, a laundry treating apparatus, i.e., a twin washer can be provided, by which a small quantity of laundry or laundry (e.g., underwear, baby clothing) necessary to be washed by being separated from normal laundry and a large quantity of laundry can be separately washed in a single washer.

According to the present disclosure, a user can selectively wash or dry various kinds of laundry in a manner of providing a front loading type washer and a top loading type washer having capacity relatively smaller than that of the front loading type washer are provided to a top and bottom of the apparatus, respectively.

According to the present disclosure, in a laundry treating apparatus capable of separately washing laundry, a wash time of a second washer of a top loading type provided to a top with a relatively small capacity can be reduced.

According to the present disclosure, in a laundry treating apparatus having a second washer of a top loading type, user's convenience and wash performance can be enhanced in a manner of enabling a detergent supply.

According to the present disclosure, in a laundry treating apparatus capable of separate wash by having a second washer of a top loading type, wash water can be prevented from flowing backward in the cycle of a wash if a diameter of the second washer is relatively greater than a height of the tub.

According to the present disclosure, in a laundry treating apparatus capable of separate wash by having a second washer of a top loading type, tap water and detergent water can be smoothly supplied and the supply of the tap water and the detergent water can be controlled to prevent the wash water supplied into a tub from flowing backward or jetting out of a tub.

Effects obtainable from the present disclosure may be non-limited by the above mentioned effect. Other unmentioned effects can be clearly understood from the following description by those having ordinary skill in the technical field to which the present disclosure pertains.

Figure 2:
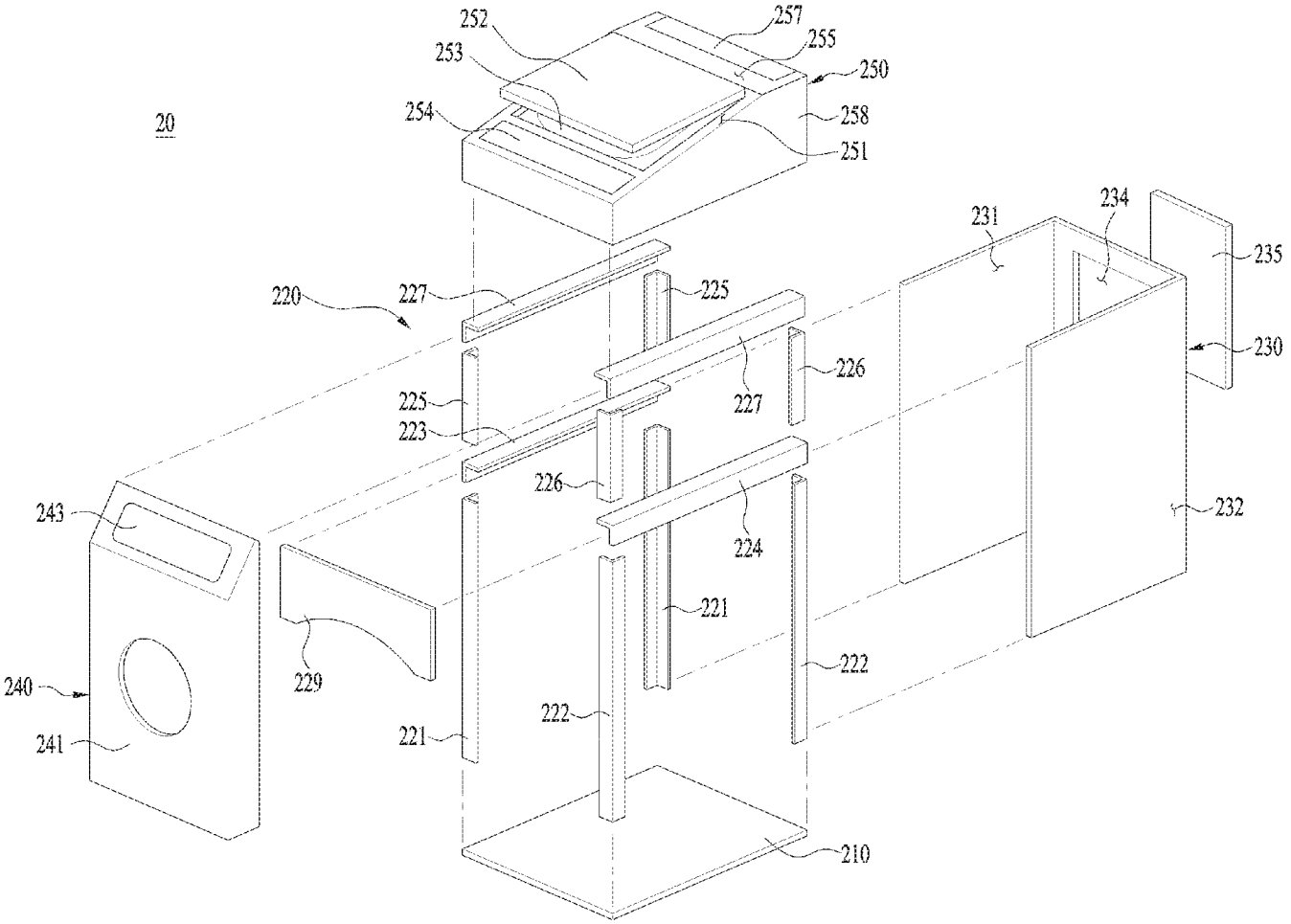
FIG. 2 is an exploded perspective diagram illustrating an assembled state of an example laundry treating apparatus according to the present disclosure.
Figure 3:
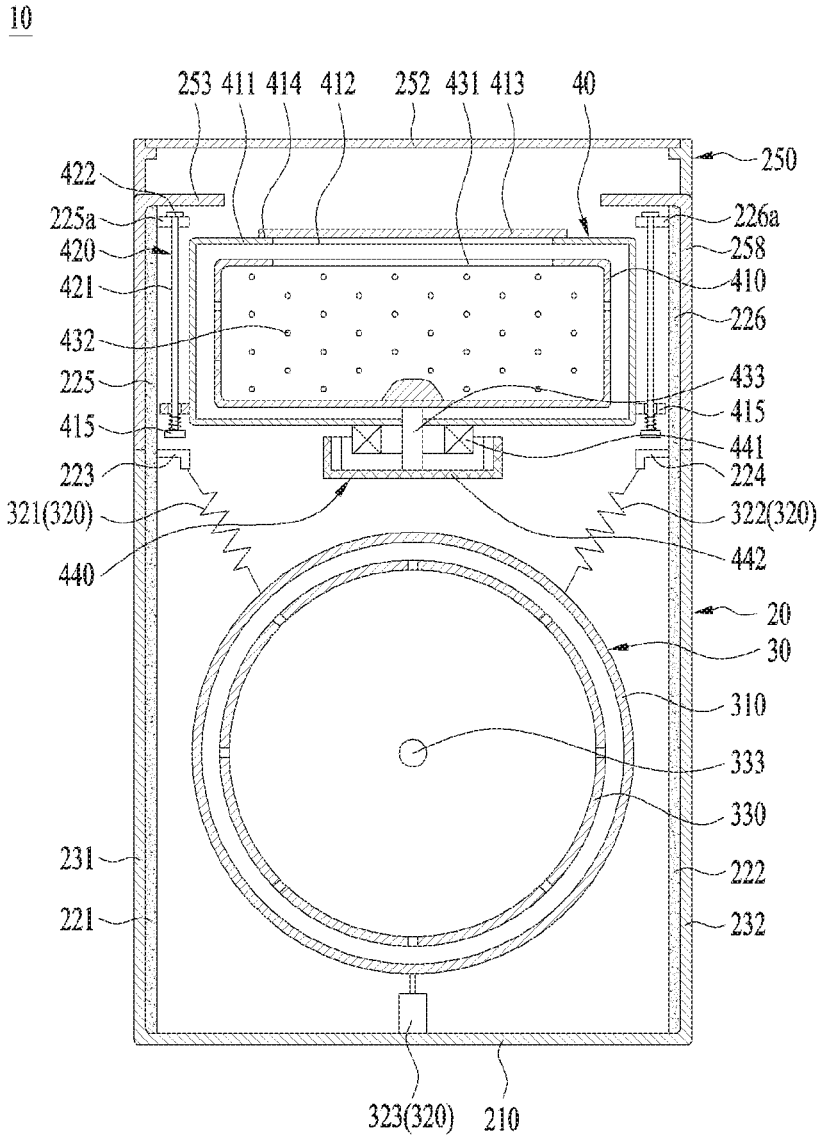
FIG. 3 is a front cross-sectional diagram schematically showing an inner structure of an example laundry treating apparatus according to the present disclosure.

FIG. 1 is a perspective diagram of a laundry treating apparatus according to the present disclosure, FIG. 2 is an exploded perspective diagram showing an assembled state of a laundry treating apparatus according to the present disclosure, and FIG. 3 is a front cross-sectional diagram schematically showing an inner structure of a laundry treating apparatus according to the present disclosure.

Referring to FIGS. 1-3, a laundry treating apparatus 10 according to the present disclosure may include a first wash unit 30 configured to enable laundry to be inserted therein or withdrawn therefrom in a front direction by having a first door 242 provided to a bottom to be opened/closed and a second wash unit 40 configured to enable laundry to be inserted therein or withdrawn therefrom in a top direction by being located on the first wash unit 30.

The second wash unit 40 and the first wash unit 30 may be independently supported by a tub case and a bottom housing, which form separate spaces, respectively, or may be integrally formed within a single housing 20 forming at least two spaces including a top space and a bottom space inside.

In some implementations, the second wash unit 40 and the first wash unit 30 are washers. In some other implementations, the second wash unit 40 or the first wash unit 30 may further include a dry function. In certain implementations, the second wash unit 40 or the first wash unit 30 may be substituted with a dryer.

In some implementations, the housing 20 is configured with two spaces (top space and bottom space) in a single housing 20. In some other implementations, laundry treating apparatus 10 can include a first wash unit 30 of a front loading type and a second wash unit 40 of a top loading type.

The laundry treating apparatus 10 according to the present disclosure may include a base 210, a frame 220 configured with a multitude of unit frames assembled together to support the first wash unit 30 and the second wash unit 40 by being provided on the base 210, a front panel 240 forming a front side of the frame 220, an outer panel 230 forming a bottom outer side of the frame 220 and an exterior of the first wash unit 30, and a tub case 250 forming a top of the frame 220 and an exterior of the second wash unit 40.

The frame 220 is mounted on the base 210 so as to support the respective components of the first wash unit 30 and the second wash unit 40. The frame 220 may include first and second bottom vertical frames 221 and 222 supporting the first wash unit 30, first and second bottom horizontal frames 223 and 224 connecting the first and second bottom vertical frames 221 and 222, first and second top vertical frames 225 and 26 supporting the second wash unit 40, and first and second top horizontal frames 227 and 228 connecting the first and second top vertical frames 225 and 226.

The first and second bottom vertical frames 221 and 222 are provided to each of one side and the other side of the base 210 as a pair. The first and second bottom horizontal frames 223 and 224 connect the top of a pair of the bottom vertical frames 221 and 222 to reinforce rigidity of the first and second bottom vertical frames.

The first and second bottom vertical frames 221 and 222 may be configured to support the first wash unit 30 together with the outer panel 230 by being joined to edges of the outer panel 230. The first and second bottom horizontal frames 223 and 224 may be configured to support the first wash unit 30 together with the outer panel 230 by being connected to the first and second bottom vertical frames 221 and 222 and also being fixed to both top ends of the outer panel 230.

The first and second top vertical frames 225 and 226 are provided onto each of one side and the other side of the first and second bottom horizontal frames 223 and 224, as a pair. The first and second top vertical frames 225 and 226 are provided in a manner of being joined to top sides of the first and second bottom horizontal frames 223 and 224. The first and second top vertical frames 225 and 226 may be joined to the first and second bottom horizontal frames 223 and 224 on extension lines of the first and second bottom vertical frames 221 and 222, respectively.

First and second brackets **225*a* and 226*a* are formed on top ends of the first and second top vertical frames 225 and 226 so that a second tub support part 420 (described later) of the second wash unit 40 can be held. First and second support holes (not shown) are formed in the first and second brackets 225*a* and 226*a* for holding the second tub support part 420. The first and second brackets 225*a* and 226*a* and the first and second support holes 225*b* and 226*b* shall be described in detail in the description of the second wash unit 40**.

The first and second top horizontal frames 227 and 228 are joined to top sides of the first and second top vertical frames 225 and 226 to reinforce rigidity of the first and second top vertical frames 225 and 226 in order to support the second wash unit 40.

In front of the first and second bottom vertical frames 221 and 222, a front frame 229 is provided in order to reinforce joined rigidity of the first and second bottom vertical frames 221 and 222 and also fix the front panel 240 thereto.

Herein, the front frame 229 may be formed across front sides of the first and second bottom vertical frames 221 and 222 and the first and second top vertical frames 225 and 226, or may be provided to the front sides of the first and second bottom vertical frames 221 and 222 only.

In case of being provided to the first and second bottom vertical frames 221 and 222, the front frame 229 may be formed entirely or in part except a first entrance 241 formed in the front panel 240 described later. According to the present disclosure, a case that the front frame 229 is located in front of top portions of the first and second bottom vertical frames by avoiding the first entrance 241 of the front panel 240 is taken as one example of the description.

The outer panel 230 is configured to enclose the first and second bottom vertical frames 221 and 222 except a front direction of an outer lateral side of the first and second bottom vertical frames 221 and 222. The outer panel 230 includes a left lateral side 231 forming a left lateral side of the first wash unit 30, a right lateral side 232 forming a right lateral side of the first wash unit 30, and a rear side 233 forming a rear side of the first wash unit 30. The first and second bottom horizontal frames 223 and 224 may be joined to top ends of the left and right lateral sides 231 and 232 of the outer panel 230.

Herein, the pairs of the first and second bottom vertical frames 221 and 222 may be joined to front edges of the left and right lateral sides 231 and 232 and rear edges formed by the left lateral side 231, the right lateral side 232 and the rear side 233, respectively. Since the outer panel 230 and the first and second bottom vertical frames 221 and 222 are joined to each other, support rigidity of the first and second bottom vertical frames 221 and 222 can be reinforced.

A bottom service hole 234 may be formed in the rear side of the outer panel 230 for the maintenance of the first wash unit 30. A service panel 235 for opening/closing the bottom service hole 234 may be further provided to the bottom service hole 234. The service panel 235 is detachably attached to the bottom service hole 234 through a fastener, such as a bolt and the like.

The front panel 240 is joined in front of the frame 220 so as to form a front side of each of the second wash unit 40 and the first wash unit 30. The front panel 240 may include the first entrance 241 to insert laundry in the first wash unit 30. A first door 242 configured to open/close the entrance 241 may be provided to the first entrance 241. Herein, the first door 242 is joined to one side of the first entrance 241 through a separate hinge (not shown) and is able to open/close the first entrance 241 in a manner of being revolving on the hinge as an axis. A light-transmissive window (not shown) of transparent material may be further provided to the first door 242 to check an operation status of the first wash unit 30.

A control panel 243 is provided to a top side of the front panel 240 to control the first and second wash units 30 and 40. The control panel 243 may include an input unit (not shown) for inputting a control command to each of the wash units 30 and 40 and a display unit (not shown) configured to display a control command selectable by a user and execution information of the control command selected by the user.

The input unit and the display unit provided to the control panel 243 are electrically connected through a PCB (printed circuit board) provided to a controller 50. Herein, the controller 50 may be fixed to the front frame 229 or embedded in the second wash unit 40. As to the controller 50 provided to the second wash unit 40, that will be described in detail in the description of the second wash unit 40.

A tub case 250 forms a top shape of the laundry treating apparatus 10 and also forms an exterior of the second wash unit 40. Meanwhile, as to the tub case 250, that will be described in detail after the description of configurations of the second wash unit 40 and the first wash unit 30.

Since the laundry treating apparatus 10 according to the present disclosure may be internally divided into the first wash unit 30 and the second wash unit 40, it can be externally divided into the front panel 240 forming the front side of the laundry treating apparatus 10, the outer panel 230 forming the exterior of the first wash unit 30, and the tub case 250 configuring the second wash unit 40.

Figure 4:
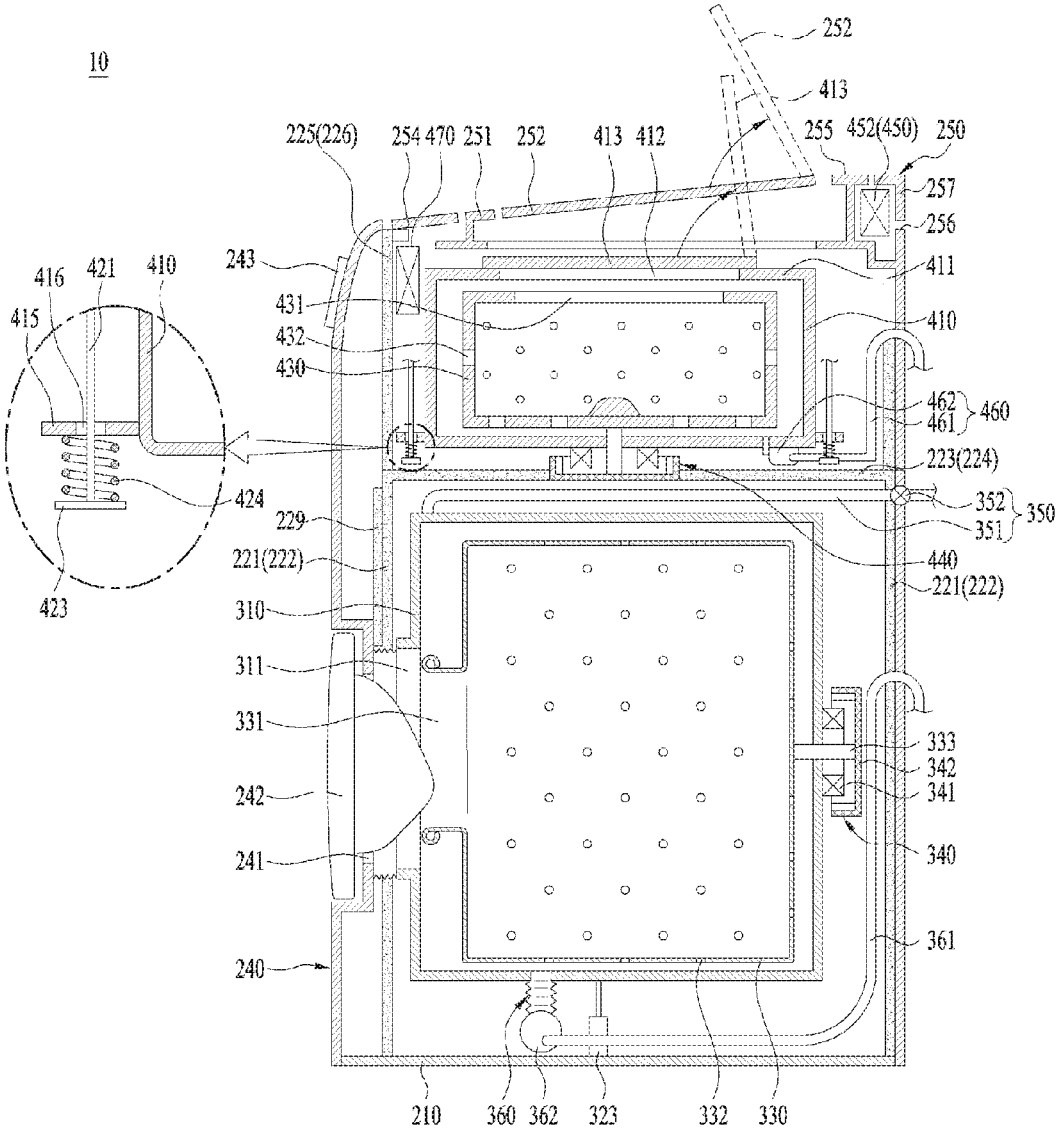
FIG. 4 is a side cross-sectional diagram schematically showing an inner structure of an example laundry treating apparatus according to the present disclosure.

Referring to FIGS. 3 and 4, the first wash unit 30 includes a first tub 310 storing a tap water supplied from an external water supply source and a wash water having a tap water and a detergent mixed therein, a first tub support part 320 supporting the first tub 310 against the base 210 and the first and second bottom horizontal frames 223 and 224 by buffering, a first drum 330 rotatably provided within the first tub 310 to wash, rinse and dewater laundry by being rotated, a first drive unit 340 provided in rear of the first tub 310 to rotate the first drum 330, a first water supply part 350 supplying the wash water to the first tub 310, and a first drain part 360 draining the wash water of the first tub 310.

The first tub 310 is configured in a cylindrical shape having a first tub entrance 311 formed in a front direction of the first tub 310 at a location corresponding to the first entrance formed in the front panel 240 of the housing 20.

Herein, a first tub sealing part 312 is formed between the first tub entrance 311 and the first entrance 241 to seal a space between the first tub entrance 311 and the first entrance 241. The first tub 310 is configured in the cylindrical shape having a rotation axis in a relatively horizontal direction and the first drive unit 340 is fixed to a rear side of the first tub 310 to rotate the first drum 330.

The first tub support part 320 includes a first spring 321 supporting one side of the first tub 310 by being held by the first bottom horizontal frame 223 to enable the first tub 310 to be held against the first bottom horizontal frame 223 and the second bottom horizontal frame 224, a second spring 322 supporting the other side of the first tub 310 by being held by the second bottom horizontal frame 224, and a damper 323 installed on the base 210 of the housing 20 to buffer vibration of the first tub 310.

The first drum 330 is rotatably installed within the first tub 310 and is configured in a cylindrical shape having a first drum entrance 331 formed at a location extended to the first tub entrance 311 of the first tub 310.

Herein, a multitude of perforated holes 332 are formed in an inner circumference of the first drum 330 to enable the wash water of the first drum 330 to flow into the first tub 310, and a first rotation shaft 333 supported by perforating the rear side of the first tub 310 is provided in rear of the first drum 330. The first rotation shaft 333 is connected to the first drive unit 340 provided in rear of the first tub 310.

The first drive unit 340 includes a first stator 341 fixed to the rear side of the first tub 310 and a first rotor 342 connected to the first rotation shaft 333 so as to be rotated by the first stator 341.

A first water supply part 350 is provided over the first tub 310 so as to supply the wash water to the first tub 310. The first water supply part 350 includes a first supply line 351 connected to an external wash water supply source and a first water supply valve 352 controlling wash water supply through the first supply line 351.

Between the first supply line 351 and the first tub 310, a first detergent supply part 370 (refer to FIG. 12) configured to supply a detergent or an auxiliary detergent (e.g., fabric softener, bleach, etc.), which is mixed with the wash water supplied from the first supply line 351, to the first tub 310 may be further provided.

The first drain part 360 is provided beneath the first tub 310 to drain the wash water of the first tub 310. The first drain part 360 includes a first drain pump 362 connected to a bottom side of the first tub 310 to drain the wash water and a first drain pipe 361 connected to an outlet of the first drain pump 362.

The second wash unit 40 includes a second tub 410 storing a tap water supplied from an external water supply source and a wash water having a tap water and a detergent mixed therein, a second tub support part 420 supporting the second tub 410 against the first and second top horizontal frames 227 and 228, a second drum 430 rotatably provided within the second tub 410 to wash, rinse and dewater laundry by being rotated, a second drive unit 440 provided in rear of the second tub 410 to rotate the second drum 430, a second water supply part 450 supplying the wash water to the second tub 410, a second drain part 460 draining the wash water of the second tub 410, and a second detergent supply part 470 (470*a* to 470*d*) mixing a tap water supplied from a second water supply part and a detergent or an auxiliary detergent (e.g., fabric softener, bleach, etc.) together and then supplying the mixed water to the second tub 410.

A top side of the second tub 410 is open in a direction corresponding to a second entrance 253 formed in an inclined plane 251 of the tub case 250. The second tub 410 is configured in a cylindrical shape having a rotation axis in a relatively vertical direction, and a second rive unit 440 may be fixed to a bottom center of the second tub 410 to rotate the second drum 430.

In some implementations, the second tub 410 may include a top part having an opening open in a top direction to insert laundry therethrough, a bottom part having the second drive unit 440 fixed thereto and a perforated hole formed therein to connect the second drum 430 and the second drive unit 440, and a sidewall connecting the top part and the bottom part in a cylindrical shape. A diameter of the bottom part of the second tub 410 is formed greater than a height of the sidewall. A detergent water is supplied through the sidewall of the second tub 410 by a second detergent water supply line 451*a* to 451*d*. Tap water can be supplied through the top opening of the second tub 410 by a tap water supply line.

The top opening of the second tub 410 is provided with a second tub top side 411 closing a top of the second tub 410. In the second tub top side 411, a second tub entrance 412 for inserting/withdrawing laundry in/from the second tub 410 is formed. A tub door 413 is provided to the second entrance 412 to open/close. In some implementations, the tub door 413 may be rotatably provided to the second tub entrance 412 in a manner of being hinged.

On an inner circumference of the second tub entrance 412, a second tub sealing part 414 may be further provided in order to seal a gap between the second tub entrance 412 and the tub door 413 when the tub door 413 closes the second tub entrance 412. A light transmissive window formed of a transparent material may be further provided to the tub door 413 in order to check an operation state of the second wash unit 40.

The second tub top side 411 and the tub door 413 close the opening of the second tub 410, thereby preventing laundry or wash water stored in the second tub 410 from being discharged externally when the second drum 430 is rotated.

On an outer circumference of the second tub 410, a multitude of tub brackets 415 may be formed to be held by a second tub support part 420. Each of the tub brackets 415 may project from the outer circumference of the second tub 410 between edges of a space formed by the outer circumference of the second tub 410 and the first and second top vertical frames 225 and 226. And a tub support hole 416 is formed in each of the tub brackets 415 so that the second tub support part 420 can be inserted in the tub support hole 416.

The second tub support part 420 is provided between the first and second brackets 225*a* and 226*a* provided to top ends of the first and second top vertical frames 225 and 226 and the tub bracket 415 formed on the outer circumference of the second tub 410 and configured to support the second tub 410 in a suspended state in order to enable the second tub 410 to make pendulum movements.

The second tub support part 420 may include a top stopper 422 provided to a top end of the second tub support part 420 so as to be held in first and second support holes 225*b* and 226*b* of the first and second brackets 225*a* and 226*a*, a bottom stopper 423 holding the sub support hole 416 of the tub bracket 415, and a support bar 421 maintaining a prescribed space between the top stopper 422 and the bottom stopper 423.

In some implementations related to second tub support part 420, a separate spring 424 may be additionally inserted between the tub bracket 415 and the bottom stopper 423 in order to buffer the vibration of the second tub 410.

The second drum 430 is rotatably installed within the second tub 410 and configured in a cylindrical shape to have a second drum entrance 431 formed at a location extended from the second tub entrance 412 of the second tub 410.

A multitude of perforated holes 432 are formed in an inner circumference of the second drum 430 to enable the wash water of the second drum 430 to flow into the second tub 410. A second rotation shaft 433 is further provided to a bottom of the second drum 430 so as to be supported by perforating the bottom of the second tub 410. The second rotation shaft 433 is connected to the second drive unit 440 provided under the bottom of the second tub 410.

The second drive unit 440 includes a second stator 441 fixed to the bottom of the second tub 410 and a second rotor 442 connected to the second rotation shaft 433 so as to be rotated by the second stator 441.

A second water supply part 450 is provided at one side in rear of the second tub 410 to supply a tap water and a wash water to the second tub 410. The second water supply part 450 is connected to an external wash water supply source and includes a second water supply valve 452 controlling wash water supply through a second supply line 451 and the first supply line 351.

In some implementations, the second valve assembly 452 may include a plurality of valves according to a type (e.g., hot water, cold water, etc.) of supplied wash water and a wash water supply target (e.g., first tub 310, first detergent supply part 370, second tub 410, second detergent supply part 470 (470*a* to 470*d*), etc.). In some implementations, a plurality of the second supply lines 451 may be provided according to a type (e.g., hot water, cold water, etc.) of supplied wash water and water supply destination (e.g., first tub 310, first detergent supply part 370, second tub 410, second detergent supply part 470 (470*a* to 470*d*), etc.).

In some implementations, the second valve assembly 452 of the second water supply part 450 is provided to one side in rear of the second tub 410 and also located under a service cover 257 provided to a rear side of the tub case 250. This may enable, after opening the service cover 257 of the tub case 250, maintenance of the second water supply part 450 and the second valve assembly 452.

The second detergent supply part 470 (470*a* to 470*d*) is located between the second supply line 451 and the second tub 410. The second detergent supply part 470 supplies a detergent or an auxiliary detergent to the second tub 410 by mixing such a detergent with a tap water supplied from the second supply line 451.

A second drain part 460 is provided beneath the second tub 410 to discharge the wash water of the second tub 410. The second drain part 460 includes a second drain pump 462 connected to a bottom side of the second tub 410 to drain the wash water and a second drain pipe 461 connected to an outlet of the second drain pump 462.

Figure 5:
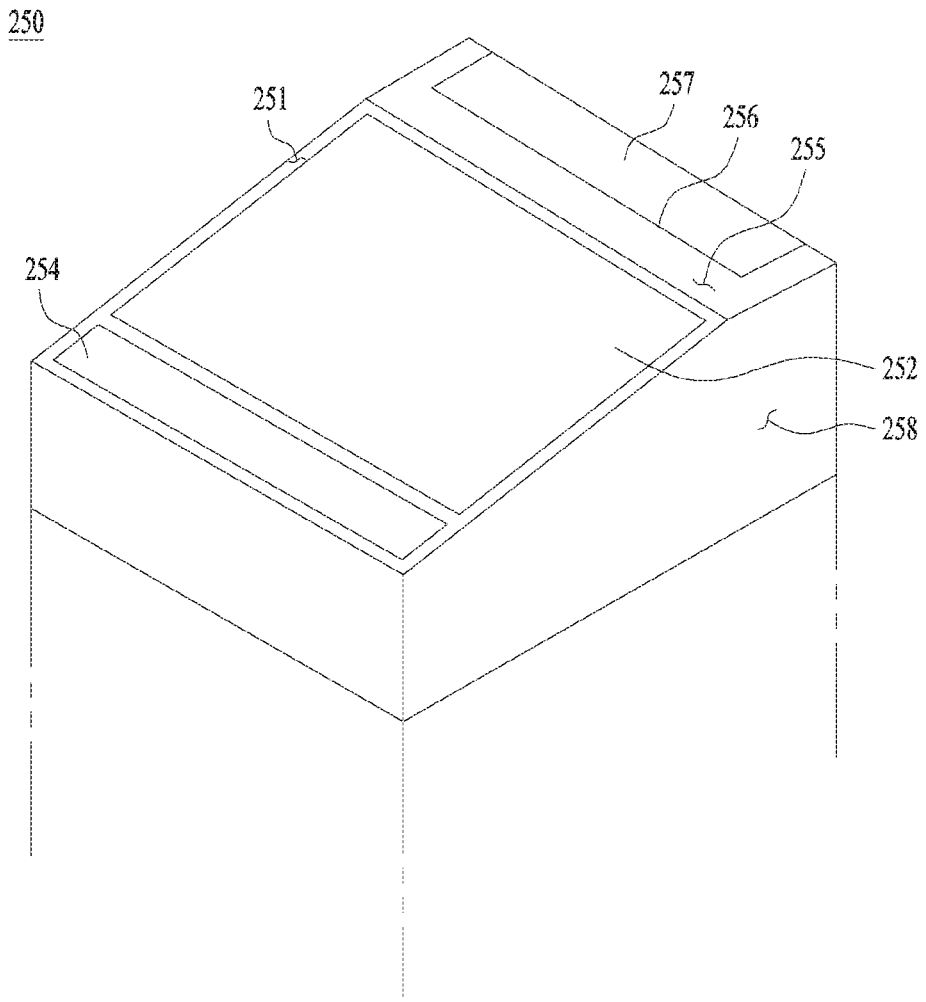
FIG. 5 is a perspective view illustrating an example second wash unit in an example laundry treating apparatus according to the present disclosure.
Figure 6:
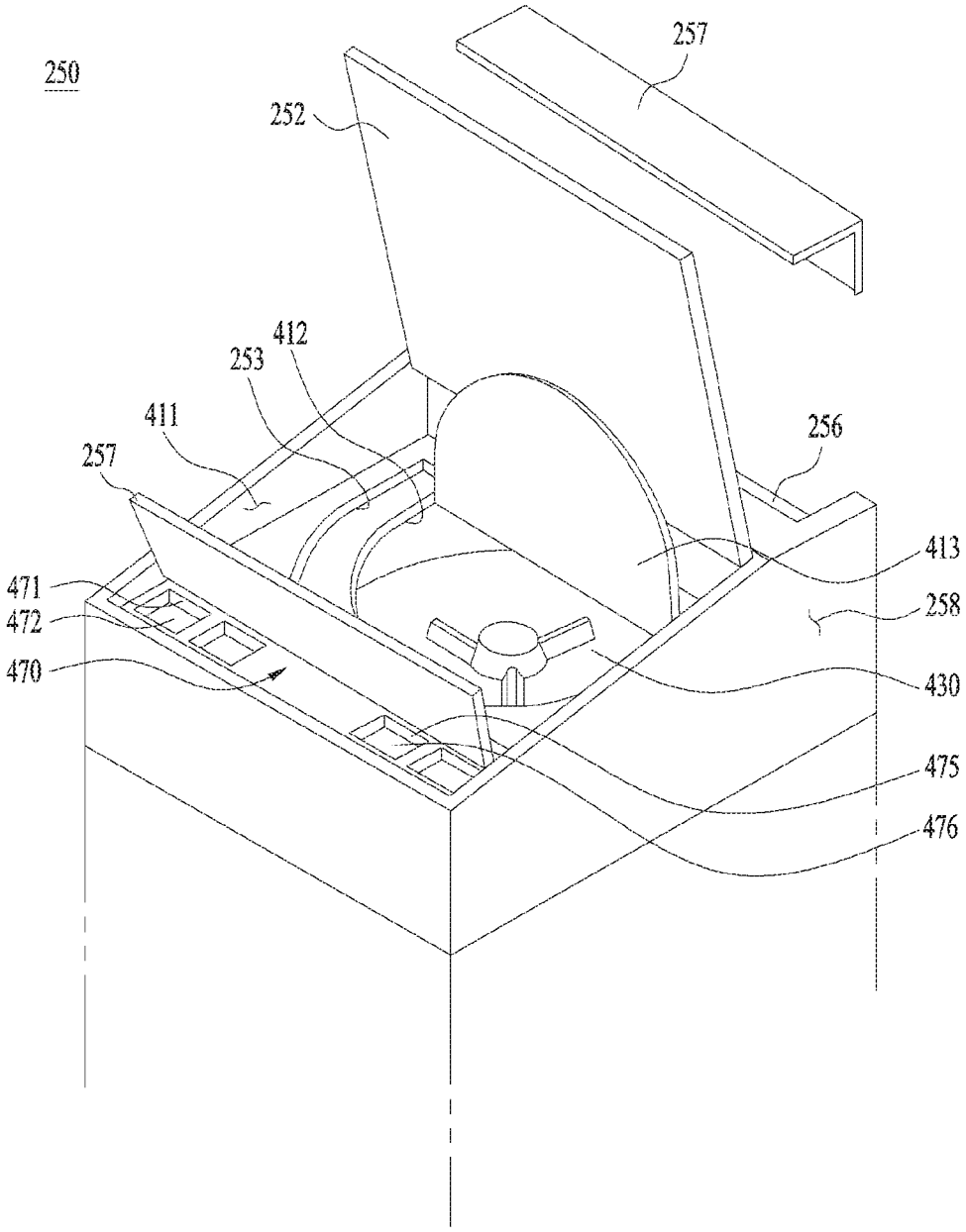
FIG. 6 is a perspective view illustrating an open state of an example second wash unit in an example laundry treating apparatus according to the present disclosure.

FIG. 5 is a perspective view illustrating a second wash unit in a laundry treating apparatus according to the present disclosure, and FIG. 6 is a perspective view illustrating an open state of a second wash unit in a laundry treating apparatus according to the present disclosure.

Referring to FIG. 5 and FIG. 6, the tub case 250 is configured in a housing shape having an open bottom side. A top side of the tub case 250 includes an inclined plane 251 and a rear plane 255.

The inclined plane 251 is configured to gradually incline downward from a rear side of the tub case 250 to a front side thereof. The rear plane 255 is configured in a plane shape extended from a rear side of the inclined plane 251.

An outer lateral side 258 is configured in a manner of being extended downward toward the first wash unit 30 from outer edges of the inclined plane 251 and the rear plane 255. The outer lateral side 258 forms an exterior shape of the second wash unit 40.

In some implementations, the inclined plane 251, the rear plane 255 and the outer lateral side 258 of the tub case 250 may be formed of separate panels, respectively and then assembled together. In some other implementations, the inclined plane 251, the rear plane 255 and the outer lateral side 258 of the tub case 250 may be integrally formed of synthetic resin material by injection molding.

A tub cover 252 for inserting/withdrawing laundry in/from the second wash unit 40 is provided to a center portion of the inclined plane 251, and a detergent insertion door 254 for inserting a detergent and/or an auxiliary detergent into the second wash unit 40 is provided to a front side of the inclined plane 251 (i.e., in front of the tub cover 252). Herein, the tub case 250 is provided with a hinge part to be rotatably coupled with the tub cover/detergent insertion door.

In some implementations, an external tap water supply line may be connected to a rear top end of the tub case 250. The external tap water supply line is connected to the second valve assembly 452 (452*a* to 452*d*) provided within the tub case 250.

In some implementations, the second detergent supply part 470 (470*a* to 470*d*) may be located under the detergent insertion door 254. In other words, the second detergent supply part 470 (470*a* to 470*d*) may be configured to be exposed if the detergent insertion door 254 is opened. In some other implementations, the second detergent supply part 470 (470*a* to 470*d*) may be located under the tub cover 252 provided to the tub case 250 so as to be exposed if the tub cover 252 is opened.

A second entrance 253 may be formed under the tub cover 252 to as to insert/withdraw laundry in/from the second wash unit 40. The second entrance 253 is formed greater than the tub door 413 provided to the second wash unit 40.

The tub cover 252 and the detergent insertion door 254 are formed on the inclined plane formed in the tub case 250. For the convenience of a user, the detergent insertion door 254 may be located in front of the tub cover 252.

Namely, since laundry weight is relatively light and a detergent or an auxiliary detergent is relatively heavier than laundry, the detergent insertion door 254 may be located in front of the tub cover 252 to enhance a user's convenience.

In the rear plane 255 of the tub case 250, a top service hole 256 configured to open a rear side of the second wash unit 40 for maintenance of the second wash unit 40 is formed. A service cover 257 is provided to the service hole 256 so as to open/close the top service hole 256.

The service cover 257 may be detachably provided to the top service hole 256 through a separate fastener, such as a bolt and the like. Meanwhile, within a rear inside of the tub case 250, the second water supply part 450 (450*a* to 450*d*) of the second wash unit 40 and the controller 50 for controlling the second wash unit 40 and the first wash unit 30 may be provided. Hence, when the service cover 257 is open, the top service hole 256 is open as well, whereby maintenance of the second wash unit 40 and the first wash unit 30 can be performed.

In some implementations, the tub case 250 may be formed integrally by injection molding. In certain implementations, the tub case 250 may include a top body and a bottom body. Herein, the second water supply part 450 (450*a* to 450*d*) and the second detergent water supply line 451 (451*a* to 451*d*) may be extended to the second valve assembly 452 (452*a* to 452*d*) from an inside of the tub case 250.

Figure 7:
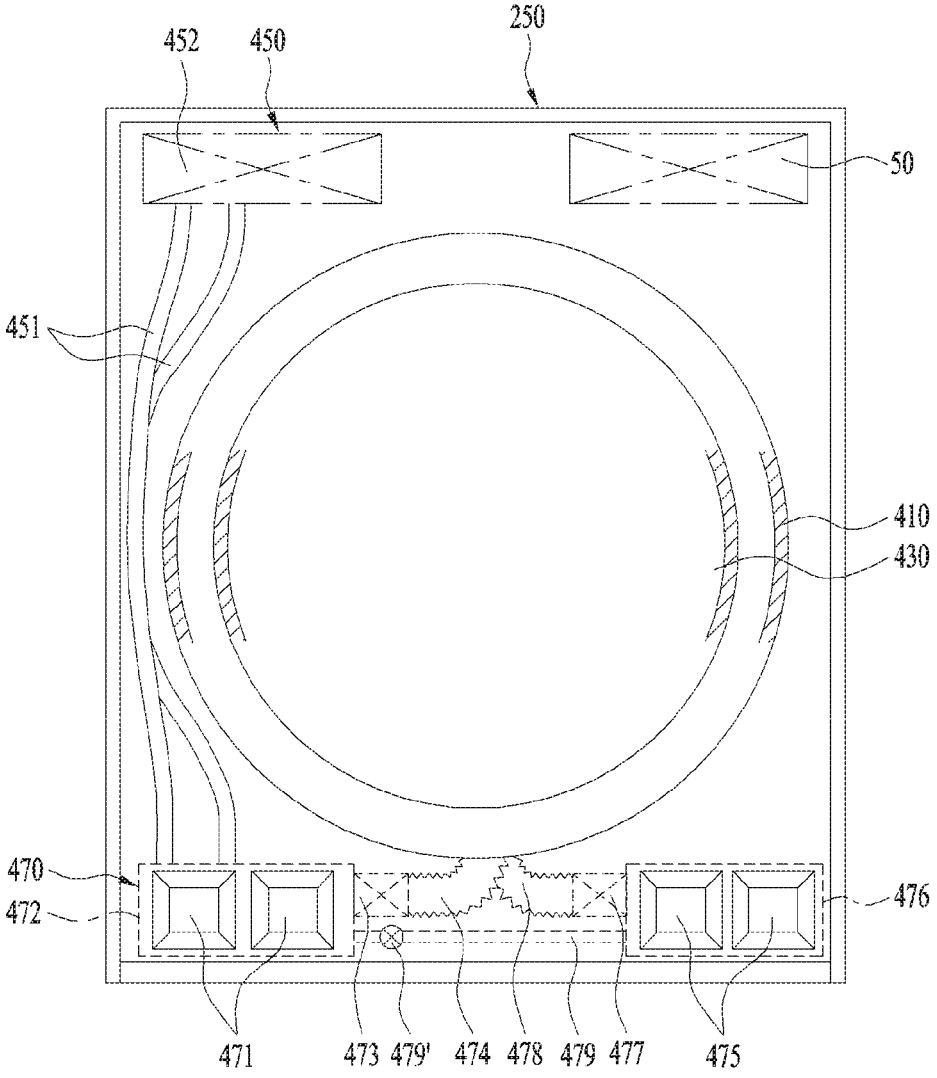
FIGS. 7-11 are layout diagrams showing an inner structure of an example implementation of a second wash unit in a laundry treating apparatus according to the present disclosure.

FIGS. 7 to 11 describe the second detergent supply part of the present disclosure. Referring to FIG. 7, a first implementation of a second wash unit in a laundry treating apparatus according to the present disclosure is described in detail.

Referring to FIG. 7, a second detergent supply part 470 according to a first implementation of the present disclosure may be selectively located at both front sides of the second tub 410. The second detergent supply part 470 may be configured to enable a liquid detergent, a powder detergent, a fabric softener, an auxiliary detergent and the like to be selectively inserted.

Herein, the second detergent supply part 470 may include a detergent entrance 471 provided to one side in front of the second tub 410 in order to insert a liquid detergent or a powder detergent for a wash of laundry and an auxiliary detergent entrance 475 provided to the other side in front of the second tub 410 in order to insert an auxiliary detergent (e.g., fabric softener, bleach, etc.) playing an auxiliary role in washing laundry.

A detergent storage part 472 is provided under the detergent entrance 471 so as to temporarily store the inserted liquid or powder detergent. The detergent storage part 472 is connected to a second supply line 451 extended from the second valve assembly 452. The detergent (e.g., a liquid detergent or a powder detergent) inserted in the detergent storage part 472 may be mixed with the wash water supplied from the second supply line 451 and then supplied to the second tub 410.

As to the first implementation of the present disclosure, through the second supply line 451, the tap water supposed to be supplied to the second tub 410 and the wash water supposed to supply the detergent stored in the detergent storage part 472 may be supplied.

In some implementations, tap water supplied from the second supply line 451 may become the tap water supplied to the second tub 410 if a detergent is not stored in the detergent storage part 472. Alternatively, tap water supplied from the second supply line 451 may become the wash water for dissolving the detergent if the detergent is stored in the detergent storage part 472. Thus, the second supply line 451 may supply the tap water and the wash water to the second tub 410 via the detergent storage part 472.

Under the detergent storage part 472, a detergent water supply pipe 474 is provided so as to supply the detergent and wash water mixed in the detergent storage part 472 to the second tub 410. The detergent supply water pipe 474 may be provided with a detergent water supply valve 473 configured to control the supply of the detergent and wash water mixed in the detergent storage part 472.

In some implementations, a plurality of the detergent water supply pipes 474 may be provided. An auxiliary detergent water supply pipe 479 for supplying an auxiliary detergent may be further provided.

Particularly, the detergent water supply pipe 474 and the auxiliary detergent water supply pipe 478 are connected to different locations on the sidewall of the second tub 410. The auxiliary detergent water supply pipe 478 may be connected to the sidewall of the second tub 410 in a manner that the connected location of the auxiliary detergent water supply pipe 478 may be relatively lower than that of the detergent water supply pipe 474. In some implementations, when the detergent water supply part 474 and the auxiliary detergent water supply pipe 478 are connected to the sidewall, they may have an overlapping region.

In some implementations, the detergent water supply part 474 and the auxiliary detergent water supply pipe 478 may be located and extended in a shape symmetric to each other centering on the second wash unit 40 or in opposite directions.

Thus, the extended directions and installation locations of the detergent water supply part 474 and the auxiliary detergent water supply pipe 478 may be selectively formed depending on whether a space between the second tub 410 and the tub case 250 is secured. As to the connections between the detergent water supply part 474 and the auxiliary detergent water supply pipe 478 and the sidewall of the second tub 410, it is able to increase the installation degree of freedom of the detergent water supply part 474 and the auxiliary detergent water supply pipe 478.

The detergent water supply pipe 474 may be configured in a bellows shape to prevent vibration from being transferred to the second tub 410 on rotating the second drum 430. The detergent water supply valve 473 may be provided between the detergent water supply pipe 474 and the detergent storage part 472, thereby controlling the supply of the detergent and wash water of the detergent storage part 472 and preventing the wash water of the second tub 410 from flowing backward to the detergent storage part 472.

In some operating conditions, as to the second tub 410, it may occur that the wash water flows backward to the detergent storage part 472 through the detergent water supply pipe 474 connected to the second tub 410 by centrifugal force of the second drum 430 rotated within the second tub 410. Therefore, when the second drum 430 is rotated, the detergent water supply valve 473 closes the detergent water supply pipe 474 so as to prevent the wash water of the second tub 410 from flowing backward through the detergent water supply pipe 474 due to the centrifugal force.

In some implementations, the detergent water supply valve 473 may be provided with a check valve for preventing the wash water of the second tub 410 from flowing backward. In some other implementations, the detergent water supply valve 473 may include an electronic valve configured to open/close the detergent water supply pipe 474 under the control of the controller 50.

Under the auxiliary detergent entrance 475, an auxiliary detergent storage part 476 may be configured to temporarily store inserted auxiliary detergent such as fabric softener, bleach and the like. To the auxiliary detergent storage part 476, the second supply line 451 extended from the second valve assembly 452 or a connecting pipe 479 extended from the detergent storage part 472 may be connected.

Herein, an auxiliary detergent inserted in the auxiliary detergent storage part 476 may be mixed with the wash water supplied from the second supply line 451 or the wash water supplied from the connecting pipe 479 through the detergent storage part 472 and then supplied to the second tub 410.

Under the auxiliary detergent storage part 476, an auxiliary detergent water supply pipe 478 is provided so as to supply the auxiliary detergent (e.g. fabric softener) and wash water mixed in the auxiliary detergent storage part 476 to the second tub 410. The auxiliary detergent supply water pipe 478 is provided with an auxiliary detergent water supply valve 477 configured to control the supply of the auxiliary detergent (e.g. fabric softener) and wash water mixed in the auxiliary detergent storage part 476.

The auxiliary detergent water supply pipe 478 may be configured in a bellows shape to prevent vibration from being transferred to the second tub 410 on rotating the second drum 430. The auxiliary detergent water supply valve 477 is provided between the auxiliary detergent water supply pipe 478 and the auxiliary detergent storage part 476, thereby controlling the supply of the auxiliary detergent of the auxiliary detergent storage part 472 and preventing the wash water of the second tub 410 from flowing backward to the auxiliary detergent storage part 476.

In some operating conditions, as to the second tub 410, it may occur that the wash water flows backward to the auxiliary detergent storage part 476 through the auxiliary detergent water supply pipe 478 connected to the second tub 410 by centrifugal force of the second drum 430 rotated within the second tub 410. Therefore, when the second drum 430 is rotated, the auxiliary detergent water supply valve 477 closes the auxiliary detergent water supply pipe 478 to prevent the wash water of the second tub 410 from flowing backward through the auxiliary detergent water supply pipe 478 due to the centrifugal force.

In some implementations, the auxiliary detergent water supply valve 477 may be provided with a check valve for preventing the wash water of the second tub 410 from flowing backward. In some other implementations, the auxiliary detergent water supply valve 477 may include an electronic valve configured to open/close the auxiliary detergent water supply pipe 478 under the control of the controller 50.

Now, as to the aforementioned second detergent supply part of the first implementation of the present disclosure, the detergent supply and the auxiliary detergent supply are described in detail as follows.

First of all, as the laundry treating apparatus 10 is operating, a user may insert a detergent (e.g., liquid detergent, powder detergent, etc.) through the detergent entrance 471 of the second detergent supply part 470 or an auxiliary detergent (e.g., fabric softener, bleach, etc.) through the auxiliary detergent entrance 475.

The detergent inserted in the detergent entrance 471 is stored in the detergent storage part 472. Since the detergent water supply valve 473 provided to the detergent water supply pipe 474 maintains a closed state, the detergent stored in the detergent storage part 472 is prevented from being immediately inserted into the second tub 410.

The auxiliary detergent inserted in the auxiliary detergent entrance 475 is stored in the auxiliary detergent storage part 476. Since the auxiliary detergent water supply valve 477 provided to the auxiliary detergent water supply pipe 478 maintains a closed state, the auxiliary detergent stored in the auxiliary detergent storage part 476 is prevented from being immediately inserted into the second tub 410.

As the wash process of the laundry treating apparatus proceeds, wash water is supplied from an external water supply source. The supplied wash water is supplied to the second detergent supply part 470 through the second supply line 451 according to an operation of the second valve assembly 452 of the second water supply part 450. The wash water supplied to the second detergent supply part 470 is supplied to the detergent storage part 472 of the second detergent supply part 470. The wash water is inserted in the detergent storage part 472 and then mixed with a detergent stored in the detergent storage part 472.

Thereafter, the wash water mixed with the detergent in the detergent storage part 472 can be supplied to the second tub 410 if the detergent water supply valve 473 provided to the detergent water supply pipe 474 is opened.

The auxiliary detergent stored in the auxiliary detergent storage part 476 may be supplied to the second tub 410 together with a wash water in a manner of being supplied with the wash water supplied to the detergent storage part 472.

As to the auxiliary detergent stored in the auxiliary detergent storage part 476, the water supplied to the detergent storage part 472 is transferred to the auxiliary detergent storage part 476 though the connecting pipe 479 connecting the detergent storage part 472 and the auxiliary detergent storage part 476 and then mixed with the auxiliary detergent stored in the auxiliary detergent storage part 476.

Thereafter, the wash water mixed with the auxiliary detergent in the auxiliary detergent storage part 476 can be supplied to the second tub 410 as the auxiliary detergent water supply valve 477 provided to the auxiliary detergent water supply pipe 478 is opened.

The connecting pipe 479, connecting the auxiliary detergent storage part 476 and the detergent storage part 472, is able to control a supply of the wash water supplied to the auxiliary detergent storage part 476 by opening/closing the connecting pipe 479.

Each of the detergent water supply pipe 474 and the auxiliary detergent water supply pipe 479 is connected to communicate with an inside of the second tub 410 by perforating the sidewall of the second tub 410. A plurality of connected points between each of the detergent water supply pipes 474 and the auxiliary detergent water supply pipes 478 and the sidewall of the second tub 410 may differ from each other in height.

In other words, the point at which the detergent water supply pipes 474 and the auxiliary detergent water supply pipes 478 are connected to the second tub 410 can be distributed into several points. A location at which the detergent water supply pipes 474 and the auxiliary detergent water supply pipes 478 are connected to the second tub 410 is connected to have a difference in elevation with respect to a wash water.

A second implementation of a second wash unit in a laundry treating apparatus according to the present disclosure is described in detail with reference to FIG. 8 as follows.

Figure 8:
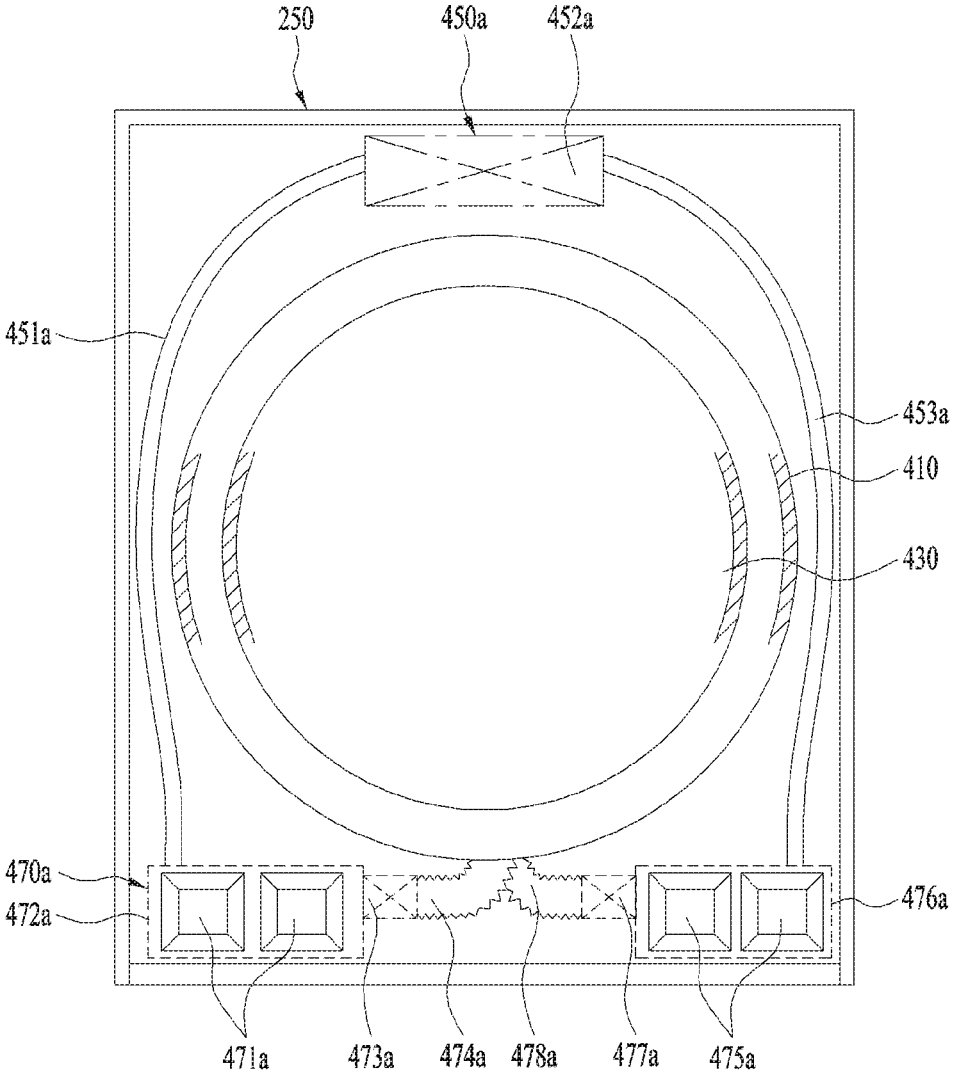

Referring to FIG. 8, a second detergent supply part 470*a* according to a second implementation of the present disclosure may include a detergent entrance 471*a* provided to one side in front of the second tub 410 to allow insertion of a detergent (e.g. a liquid detergent or a powder detergent) for a wash of laundry, and an auxiliary detergent entrance 475*a* provided to the other side in front of the second tub 410 to allow insertion of an auxiliary detergent (e.g., fabric softener, bleach, etc.) playing an auxiliary role in washing laundry.

A detergent storage part 472*a* is provided under the detergent entrance 471*a* to temporarily store the inserted detergent. An auxiliary detergent storage part 476*a* is provided under the auxiliary detergent entrance 475*a* to temporarily store the inserted auxiliary detergent.

A second water supply part 450*a* includes a second detergent water supply line 451*a* connected to the detergent storage part 472*a* by being extended from the second valve assembly 452*a*, and a second auxiliary detergent water supply line 453*a* connected to the auxiliary detergent storage part 476*a* by being extended from the second valve assembly 452*a*.

In some implementations, the second water supply part 450*a* may include at least two supply lines to supply wash water. Hence, the detergent supplied to the detergent storage part 472*a* is mixed with the wash water supplied from the second detergent water supply line 451*a*, and the auxiliary detergent supplied to the auxiliary detergent storage part 476*a* is mixed with the wash water supplied from the second auxiliary detergent water supply line 453*a*.

In some implementations, the second water supply part 450*a* may further include a line capable of additionally supplying a material (e.g., bleach) playing a role different from that of the detergent or the auxiliary detergent (e.g. fabric softener) separately from the second detergent water supply line 451*a* or the second auxiliary detergent supply line 453*a*.

As to the second implementation of the present disclosure, the tap water supposed to be supplied to the second tub 410 and the wash water supposed to supply the detergent stored in the detergent storage part 472*a* may be supplied through the second detergent water supply line 451*a*.

In some implementations, the tap water supplied from the second detergent water supply line 451*a* may become the tap water supplied to the second tub 410 if a detergent is not stored in the detergent storage part 472*a*. Alternatively, the tap water supplied from the second detergent water supply line 451*a* may become the wash water for dissolving the detergent if the detergent is stored in the detergent storage part 472*a*. Thus, the second detergent water supply line 451*a* may supply the tap water and the wash water to the second tub 410 via the detergent storage part 472*a*.

In some implementations, tap water supplied from the second detergent water supply line 451*a* may become a tap water supplied to the second tub 410 if the detergent is not stored in the auxiliary detergent storage part 476*a*. Alternatively, tap water supplied from the second detergent water supply line 451*a* may become a wash water for dissolving a detergent if the detergent is stored in the auxiliary detergent storage part 476*a*. In other words, the second detergent water supply line 451*a* may supply the tap water and the wash water to the second tub 410 via the detergent storage part 472*a* or the auxiliary detergent storage part 476*a*.

Under the detergent storage part 472*a*, a detergent water supply pipe 474*a* is provided to supply the detergent and wash water mixed in the detergent storage part 472*a* to the second tub 410. The detergent supply water pipe 474*a* may be configured in a bellows shape to prevent vibration from being transferred to the second tub 410 on rotating the second drum 430.

A detergent water supply valve 473*a* is provided to the detergent water supply pipe 474*a*, thereby controlling the supply of the detergent and wash water mixed in the detergent storage part 472*a* and preventing the wash water of the second tub 410 from flowing backward to the detergent storage part 472*a*.

In some implementations, the detergent water supply valve 473*a* may be provided with a check valve for preventing the wash water of the second tub 410 from flowing backward. In some other implementations, the detergent water supply valve 473*a* may include an electronic valve configured to open/close the detergent water supply pipe 474*a* under the control of the controller 50.

In some operating conditions, as to the second tub 410, it may occur that the wash water flows backward to the detergent storage part 472 through the detergent water supply pipe 474 connected to the second tub 410 by centrifugal force of the second drum 430 rotated within the second tub 410. Therefore, when the second drum 430 is rotated, the detergent water supply valve 473*a* closes the detergent water supply pipe 474*a* so as to prevent the wash water of the second tub 410 from flowing backward through the detergent water supply pipe 474*a* due to the centrifugal force.

Under the auxiliary detergent storage part 476*a*, an auxiliary detergent water supply pipe 478*a* is provided so as to supply the auxiliary detergent (e.g. fabric softener) and wash water mixed in the auxiliary detergent storage part 476*a* to the second tub 410. The auxiliary detergent water supply pipe 478*a* may be configured in a bellows shape to prevent vibration from being transferred to the second tub 410 on rotating the second drum 430.

The auxiliary detergent supply water pipe 478*a* is provided with an auxiliary detergent water supply valve 477*a* configured to control the supply of the auxiliary detergent (e.g. fabric softener) and wash water mixed in the auxiliary detergent storage part 476*a*. The auxiliary detergent water supply valve 477*a* is provided between the auxiliary detergent water supply pipe 478*a* and the auxiliary detergent storage part 476*a*, thereby controlling the supply of the auxiliary detergent of the auxiliary detergent storage part 476*a* and preventing the wash water of the second tub 410 from flowing backward to the auxiliary detergent storage part 476*a*.

In some implementations, the auxiliary detergent water supply valve 477*a* may be provided with a check valve for preventing the wash water of the second tub 410 from flowing backward. In some other implementations, the auxiliary detergent water supply valve 477*a* may include an electronic valve configured to open/close the auxiliary detergent water supply pipe 478*a* under the control of the controller 50.

In some operating conditions, as to the second tub 410, it may occur that the wash water flows backward to the auxiliary detergent storage part 476*a* through the auxiliary detergent water supply pipe 478*a* connected to the second tub 410 by centrifugal force of the second drum 430 rotated within the second tub 410. Therefore, when the second drum 430 is rotated, the auxiliary detergent water supply valve 477*a* closes the auxiliary detergent water supply pipe 478*a* so as to prevent the wash water of the second tub 410 from flowing backward through the auxiliary detergent water supply pipe 478*a* due to the centrifugal force. In other words, the auxiliary detergent water supply valve 477*a* can control the supply of the detergent and wash water of the auxiliary detergent storage part 476*a* and prevent the water of the second tub from flowing backward to the detergent storage part 472*a*.

As to the aforementioned second detergent supply part of the second implementation of the present disclosure, the detergent supply and the auxiliary detergent supply are described in detail as follows.

First of all, as the laundry treating apparatus 10 is operating, a user may insert a detergent (e.g., liquid detergent, powder detergent, etc.) through the detergent entrance 471*a* of the second detergent supply part 470*a* or an auxiliary detergent (e.g., fabric softener, bleach, etc.) through the auxiliary detergent entrance 475*a*.

The detergent inserted in the detergent entrance 471*a* is stored in the detergent storage part 472*a*. Since the detergent water supply valve 473*a* provided to the detergent water supply pipe 474*a* maintains a closed state, the detergent stored in the detergent storage part 472*a* is prevented from being immediately inserted into the second tub 410.

Similarly, the auxiliary detergent inserted in the auxiliary detergent entrance 475*a* is stored in the auxiliary detergent storage part 476*a*. Since the auxiliary detergent water supply valve 477*a* provided to the auxiliary detergent water supply pipe 478*a* maintains a closed state, the auxiliary detergent stored in the auxiliary detergent storage part 476*a* is prevented from being immediately inserted into the second tub 410.

As the wash process of the laundry treating apparatus proceeds, wash water is supplied from an external water supply source. The supplied wash water is supplied to the detergent storage part 472*a* and the auxiliary detergent storage part 476*a* of the second detergent supply part 470*a* through the second detergent water supply line 451*a* and the second auxiliary detergent water supply pipe 453*a* according to an operation of the second valve assembly 452*a* of the second water supply part 450*a*.

The wash water supplied to the detergent storage part 472*a* through the second detergent water supply line 451*a* is inserted in the detergent storage part 472*a* and then mixed with a detergent stored in the detergent storage part 472*a*. Then, the wash water mixed with the detergent in the detergent storage part 472*a* can be supplied to the second tub 410 if the detergent water supply valve 473*a* provided to the detergent water supply pipe 474*a* is opened.

Similarly, the wash water supplied to the auxiliary detergent storage part 476*a* through the second auxiliary detergent water supply pipe 478*a* is inserted in the auxiliary detergent storage part 476*a* and then mixed with an auxiliary detergent stored in the auxiliary detergent storage part 476*a*. Then, the wash water mixed with the auxiliary detergent in the auxiliary detergent storage part 476*a* can be supplied to the second tub 410 if the auxiliary detergent water supply valve 477*a* provided to the auxiliary detergent water supply pipe 478*a* is opened.

A third implementation of a second wash unit in a laundry treating apparatus according to the present disclosure is described in detail with reference to FIG. 9 as follows.

Figure 9:
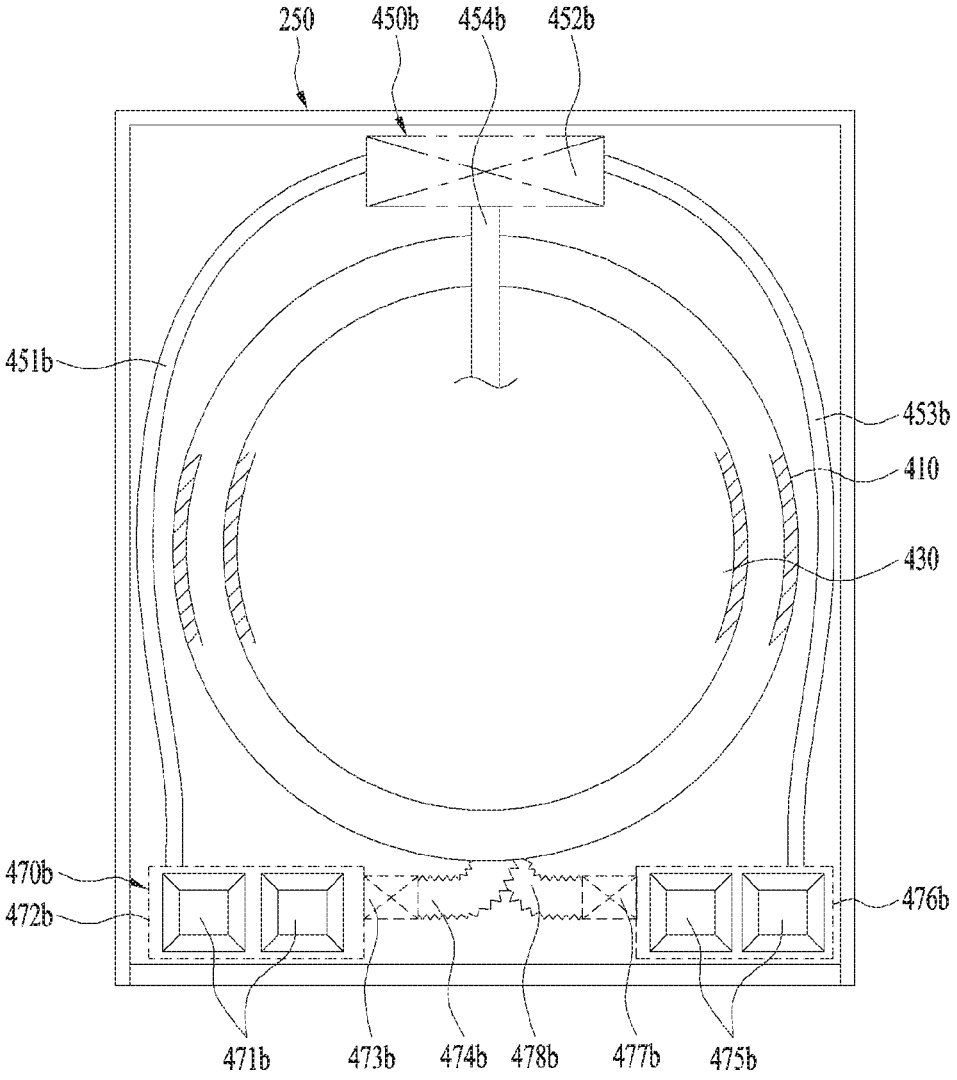

Referring to FIG. 9, a second detergent supply part 470*b* according to a third implementation of the present disclosure may include a detergent entrance 471*b* provided to one side in front of the second tub 410 in order to insert a detergent (e.g. a liquid detergent or a powder detergent) for a wash of laundry and an auxiliary detergent entrance 475*b* provided to the other side in front of the second tub 410 in order to insert an auxiliary detergent (e.g., fabric softener, bleach, etc.) playing an auxiliary role in washing laundry.

A detergent storage part 472*b* is provided under the detergent entrance 471*b* to temporarily store the inserted detergent. An auxiliary detergent storage part 476*b* is provided under the auxiliary detergent entrance 475*b* so as to temporarily store the inserted auxiliary detergent.

A second water supply part 450*b* includes a second detergent water supply line 451*b* connected to the detergent storage part 472*b* by being extended from a second valve assembly 452*b*, a second auxiliary detergent water supply line 453*b* connected to the auxiliary detergent storage part 476*b* by being extended from the second valve assembly 452*b*, and a second tap water supply line 454*b* configured to separately supply a tap water to the second tub 410. In this implementation, the second tap water supply line 454*b* can supply a wash water to the second tub 410 independently from the second detergent water supply line 451*b* or the second auxiliary detergent water supply line 453*b*.

In some implementations, the second tap water supply line 454*b* may supply the wash water to the second tub 410 by being directly connected to the second tub 410. In some other implementations, the second tap water supply line 454*b* may supply a wash water into the second tub 410 through a top opening of the second tub 410 from a top of the second tub 410 by being connected to the tub door 413 provided to the second tub 410. If the tap water is supplied through the top opening of the second tub 410, the tap water spreads and laundry can be effectively soaked in the tap water.

A detergent storage part 472*b* is provided under the detergent entrance 471*b* so as to temporarily store the inserted detergent. The second detergent water supply line 451*b* extended from the second valve assembly 452*b* is connected to the detergent storage part 472*b*. The detergent inserted in the detergent storage part 472*b* may be mixed with a wash water supplied from the second detergent water supply line 410 and then supplied to the second tub 410.

Under the detergent storage part 472*b*, a detergent water supply pipe 474*b* is provided to supply the detergent and wash water mixed in the detergent storage part 472*b* to the second tub 410. The detergent supply water pipe 474*b* may be configured in a bellows shape to prevent vibration from being transferred to the second tub 410 on rotating the second drum 430.

A detergent water supply valve 473*b* is provided to the detergent water supply pipe 474*b*, thereby controlling the supply of the detergent and wash water mixed in the detergent storage part 472*b*. The detergent water supply valve 473*b* is provided between the detergent water supply pipe 474*b* and the detergent storage part 472*b*, thereby controlling the supply of the detergent and wash water of the detergent storage part 472*b* and preventing the wash water of the second tub 410 from flowing backward to the detergent storage part 472*b*.

In some operating conditions, as to the second tub 410, it may occur that the wash water flows backward to the detergent storage part 472*b* through the detergent water supply pipe 474*b* connected to the second tub 410 by centrifugal force of the second drum 430 rotated within the second tub 410. Therefore, when the second drum 430 is rotated, the detergent water supply valve 473*b* closes the detergent water supply pipe 474*b* so as to prevent the wash water of the second tub 410 from flowing backward through the detergent water supply pipe 474*b* due to the centrifugal force.

The detergent water supply pipe 474 may be configured with a plurality of pipes, and an auxiliary detergent water supply pipe 478*b* to supply an auxiliary detergent may be further included. The detergent water supply pipe 474*b* and the auxiliary detergent water supply pipe 478*b* may be connected to different locations on the sidewall of the second tub 410.

In some implementations, the detergent water supply pipe 474*b* and the auxiliary detergent water supply pipe 478*b* may be connected to the sidewall, and they may have an overlapping region. In certain implementations, the detergent water supply part 474*b* and the auxiliary detergent water supply pipe 478*b* may be located and extended in a shape symmetric to each other centering on the second wash unit 40 or in opposite directions. The detergent water supply pipe 474*b* and the auxiliary detergent water supply pipe 478*b* may be connected to the sidewall of the second tub with an installation direction to achieve an extension line in a direction of passing through a center of the second tub 410, a direction in parallel with an extension line in a direction of passing through a center of the second tub 410, or a direction tangential to the sidewall of the second tub 410.

In some other implementations, the detergent water supply pipe 474*b* and the auxiliary detergent water supply pipe 478*b* may be connected to the sidewall of the second tub in a symmetric shape centering on the second tub 410 or in a manner of being adjacent to each other or spaced from each other in a prescribed distance.

Alternatively, the detergent water supply pipe 474*b* and the auxiliary detergent water supply pipe 478*b* may be connected to the sidewall of the second tub at a location symmetric to the second tap water supply line. In other words, the detergent water supply pipe and the auxiliary detergent water supply pipe may be connected to the sidewall of the second tub in a direction opposite to that of the second tap water supply line with reference to the second tub or on an extension line of the second tap water supply line.

Thus, the extended directions and installation locations of the detergent water supply part 474*b* and the auxiliary detergent water supply pipe 478*b* may be selectively formed depending on whether a space between the second tub 410 and the tub case 250 is secured. As to the connections between the detergent water supply part 474*b* and the auxiliary detergent water supply pipe 478*b* and the sidewall of the second tub 410, it is able to increase the installation degree of freedom of the detergent water supply part 474*b* and the auxiliary detergent water supply pipe 478*b*.

Under the auxiliary detergent storage part 476*b*, an auxiliary detergent water supply pipe 478*b* is provided so as to supply the auxiliary detergent (e.g. fabric softener) and wash water mixed in the auxiliary detergent storage part 476*b* to the second tub 410. The auxiliary detergent supply water pipe 478*b* may be configured in a bellows shape to prevent vibration from being transferred to the second tub 410 on rotating the second drum 430.

The auxiliary detergent supply water pipe 478*b* is provided with an auxiliary detergent water supply valve 477*b* configured to control the supply of the auxiliary detergent (e.g. fabric softener) and wash water mixed in the auxiliary detergent storage part 476*b*. The auxiliary detergent water supply valve 477*b* is provided between the auxiliary detergent water supply pipe 478*b* and the auxiliary detergent storage part 476*b*, thereby controlling the supply of the auxiliary detergent of the auxiliary detergent storage part 476*b* and preventing the wash water of the second tub 410 from flowing backward to the auxiliary detergent storage part 476*b*.

In some operating conditions, as to the second tub 410, it may occur that the wash water flows backward to the auxiliary detergent storage part 476*b* through the auxiliary detergent water supply pipe 478*b* connected to the second tub 410 by centrifugal force of the second drum 430 rotated within the second tub 410. Therefore, when the second drum 430 is rotated, the auxiliary detergent water supply valve 477*b* closes the auxiliary detergent water supply pipe 478*b* so as to prevent the wash water of the second tub 410 from flowing backward through the auxiliary detergent water supply pipe 478*b* due to the centrifugal force. In other words, the auxiliary detergent water supply valve 477*b* can control the supply of the detergent and wash water of the auxiliary detergent storage part 476*b* and prevent the water of the second tub from flowing backward to the auxiliary detergent storage part 476*b*.

In some implementations, each of the detergent water supply valve 473*b* and the auxiliary detergent water supply valve 477*b* may be provided with a check valve for preventing the wash water of the second tub 410 from flowing backward. In certain implementations, the detergent water supply valve 473*b* and the auxiliary detergent water supply valve 477*b* may include electronic valves configured to open/close the detergent supply pipe 474*b* and the auxiliary detergent water supply pipe 478*b* under the control of the controller 50, respectively.

As to the aforementioned second detergent supply part of the third implementation of the present disclosure, the detergent supply and the auxiliary detergent supply are described in detail as follows.

First of all, as the laundry treating apparatus 10 is operating, a user may insert a detergent (e.g., liquid detergent, powder detergent, etc.) through the detergent entrance 471*b* of the second detergent supply part 470*b* or an auxiliary detergent (e.g., fabric softener, bleach, etc.) through the auxiliary detergent entrance 475*b*.

The detergent inserted in the detergent entrance 471*b* is stored in the detergent storage part 472*b*. Since the detergent water supply valve 473*b* provided to the detergent water supply pipe 474*b* maintains a closed state, the detergent stored in the detergent storage part 472*b* is prevented from being immediately inserted into the second tub 410.

Moreover, the auxiliary detergent inserted in the auxiliary detergent entrance 475*b* is stored in the auxiliary detergent storage part 476*b*. Since the auxiliary detergent water supply valve 477*b* provided to the auxiliary detergent water supply pipe 478*b* maintains a closed state, the auxiliary detergent stored in the auxiliary detergent storage part 476*b* is prevented from being immediately inserted into the second tub 410.

As the wash process of the laundry treating apparatus proceeds, wash water is supplied from an external water supply source. The supplied wash water is supplied to the detergent storage part 472*b* and the auxiliary detergent storage part 476*b* of the second detergent supply part 470*b* through the second detergent water supply line 451*b* and the second auxiliary detergent water supply pipe 453*b* according to an operation of the second valve assembly 452*b* of the second water supply part 450*b*.

The wash water supplied to the detergent storage part 472*b* through the second detergent water supply line 451*b* is inserted in the detergent storage part 472*b* and then mixed with a detergent stored in the detergent storage part 472*b*.

Thereafter, the wash water mixed with the detergent in the detergent storage part 472*b* can be supplied to the second tub 410 if the detergent water supply valve 473*b* provided to the detergent water supply pipe 474*b* is opened. In some implementations, the water supply to the second tub 410 may be performed through the second tap water supply line 454*b* of the second water supply part 450*b* separately from the water supply of the second detergent supply part 470*b*.

The wash water supplied to the auxiliary detergent storage part 476*b* through the second auxiliary detergent water supply pipe 453*b* is inserted in the auxiliary detergent storage part 476*b* and then mixed with an auxiliary detergent stored in the auxiliary detergent storage part 476*b*. Thereafter, the wash water mixed with the auxiliary detergent in the auxiliary detergent storage part 476*b* can be supplied to the second tub 410 if the auxiliary detergent water supply valve 477*b* provided to the auxiliary detergent water supply pipe 478*b* is opened.

A fourth implementation of a second wash unit in a laundry treating apparatus according to the present disclosure is described in detail with reference to FIG. 10 as follows.

Figure 10:
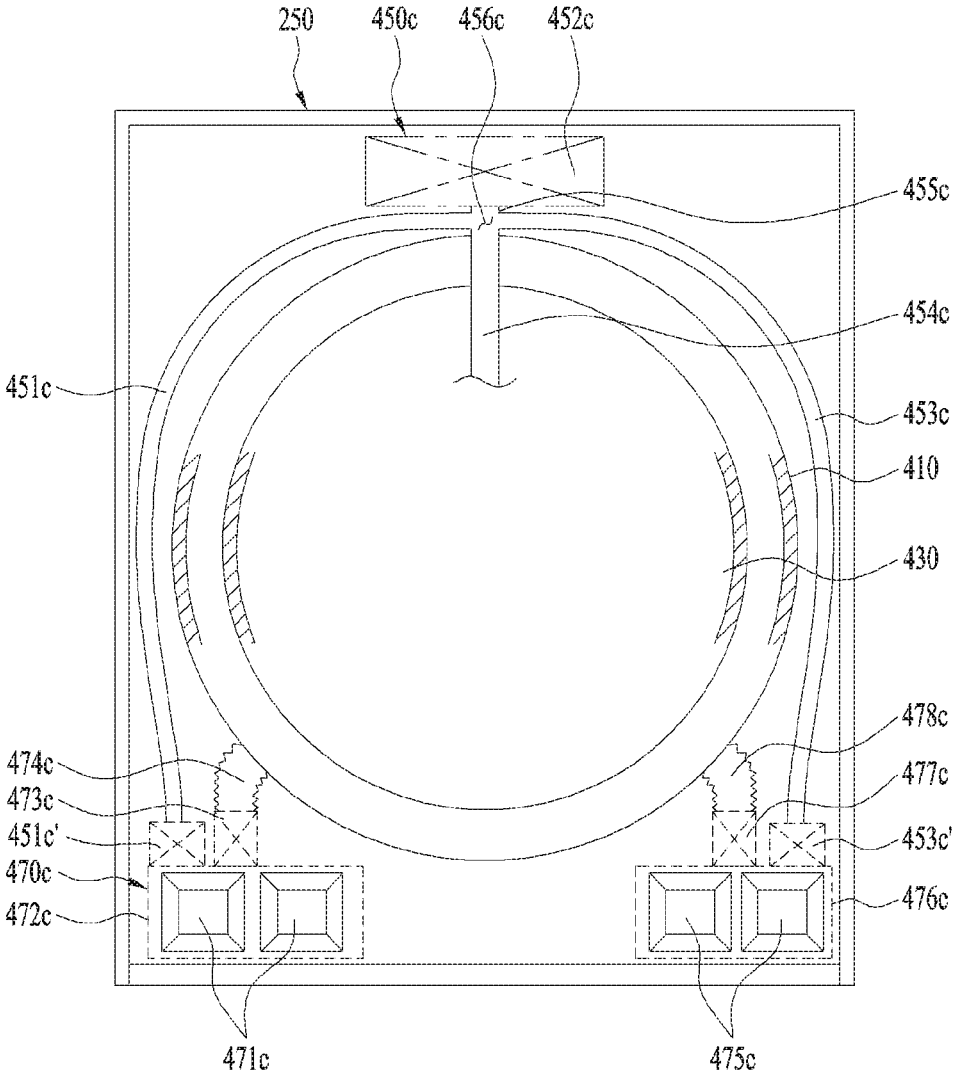

Referring to FIG. 10, a second detergent supply part 470*c* according to a fourth implementation of the present disclosure may include a detergent entrance 471*c* provided to one side in front of the second tub 410 in order to insert a liquid detergent or a powder detergent for a wash of laundry and an auxiliary detergent entrance 475*c* provided to the other side in front of the second tub 410 in order to insert an auxiliary detergent (e.g., fabric softener, bleach, etc.) playing an auxiliary role in washing laundry.

A detergent storage part 472*c* is provided under the detergent entrance 471*c* so as to temporarily store the inserted detergent. An auxiliary detergent storage part 476*c* is provided under the auxiliary detergent entrance 475*c* to temporarily store the inserted auxiliary detergent.

A second water supply part 450*c* includes a second main water supply pipe 455*c* extended from a second valve assembly 452*c*, a second detergent water supply line 451*c* connected to the detergent storage part 472*c* by diverging from the second main water supply pipe 455*c*, a second auxiliary detergent water supply line 453*c* connected to the auxiliary detergent storage part 476*c* by diverging from the second main water supply pipe 455*c*, and a second tap water supply line 454*c* diverging from the second main water supply pipe 455*c* to separately supply a wash water to the second tub 410.

In some implementations, the second detergent water supply line 451*c*, the second auxiliary detergent water supply line 453*c*, and the second tap water supply line 454*c* diverge from a specific diverging part 456*c* of the second main water supply pipe 455*c* so as to supply wash water to the detergent storage part 472*c*, the auxiliary detergent storage part 476*c* and the second tub 410, respectively. In this case, wash water can be simultaneously supplied to the second detergent water supply line 451*c*, the second auxiliary detergent water supply line 453*c*, and the second tap water supply line 454*c* through the second main water supply pipe 455*c*.

In some implementations, the second detergent water supply line 451*c* and the second auxiliary detergent water supply line 453*c* may be further provided with a separate detergent water supply valve 451*c*' and a separate auxiliary detergent water supply valve 453*c*' for the water supply control independent from the second tap water supply line, respectively. Therefore, the second tap water supply line 454*c* may supply wash water to the second tub 410 independently from the second detergent water supply line 451*c* or the second auxiliary detergent water supply line 453*c*.

In some implementations, the second tap water supply line 454*c* may supply the wash water to the second tub 410 by being directly connected to the second tub 410. In some other implementations, the second tap water supply line 454*c* may be connected to the tub door 413 provided to the second tub 410, thereby spreading to supply the wash water into the second tub 410 from a top of the second tub 410.

Under the detergent entrance 471*c*, the detergent storage part 472*c* for temporarily storing the inserted detergent is provided. The second detergent water supply line 451*c* extended from the second valve assembly 452*c* is connected to the detergent storage part 472*c*. The detergent inserted in the detergent storage part 472*c* may be mixed with the wash water supplied from the second detergent water supply line 451*c* and then supplied to the second tub 410.

Under the detergent storage part 472*c*, a detergent water supply pipe 474*c* is provided so as to supply the detergent and wash water mixed in the detergent storage part 472*c* to the second tub 410. The detergent supply water pipe 474*c* may be configured in a bellows shape to prevent vibration from being transferred to the second tub 410 on rotating the second drum 430.

A detergent water supply valve 473*c* is provided to the detergent water supply pipe 474*c*, thereby controlling the supply of the detergent and wash water mixed in the detergent storage part 472*c*. The detergent water supply valve 473*c* is provided between the detergent water supply pipe 474*c* and the detergent storage part 472*c*, thereby controlling the supply of the detergent and wash water of the detergent storage part 472*c* and preventing the wash water of the second tub 410 from flowing backward to the detergent storage part 472*c*.

In some operating conditions, as to the second tub 410, it may occur that the wash water flows backward to the detergent storage part 472*c* through the detergent water supply pipe 474*c* connected to the second tub 410 by centrifugal force of the second drum 430 rotated within the second tub 410. Therefore, when the second drum 430 is rotated, the detergent water supply valve 473*c* closes the detergent water supply pipe 474*c* to prevent the wash water of the second tub 410 from flowing backward through the detergent water supply pipe 474*c* due to the centrifugal force.

Under the auxiliary detergent storage part 476*c*, an auxiliary detergent water supply pipe 478*c* is provided to supply the auxiliary detergent (e.g. fabric softener) and wash water mixed in the auxiliary detergent storage part 476*c* to the second tub 410. The auxiliary detergent supply water pipe 478*c* may be configured in a bellows shape to prevent vibration from being transferred to the second tub 410 on rotating the second drum 430.

The auxiliary detergent supply water pipe 478*c* is provided with an auxiliary detergent water supply valve 477*c* configured to control the supply of the fabric softener (or auxiliary detergent) and wash water mixed in the auxiliary detergent storage part 476*c*. The auxiliary detergent water supply valve 477*c* is provided between the auxiliary detergent water supply pipe 478*c* and the auxiliary detergent storage part 476*c*, thereby controlling the supply of the auxiliary detergent of the auxiliary detergent storage part 476*c* and preventing the wash water of the second tub 410 from flowing backward to the auxiliary detergent storage part 476*c*.

In some operating conditions, as to the second tub 410, it may occur that the wash water flows backward to the auxiliary detergent storage part 476*c* through the auxiliary detergent water supply pipe 478*c* connected to the second tub 410 by centrifugal force of the second drum 430 rotated within the second tub 410. Therefore, when the second drum 430 is rotated, the auxiliary detergent water supply valve 477*c* closes the auxiliary detergent water supply pipe 478*c* so as to prevent the wash water of the second tub 410 from flowing backward through the auxiliary detergent water supply pipe 478*c* due to the centrifugal force.

In some implementations, the auxiliary detergent water supply valve 477*c* can control the supply of the detergent and wash water of the auxiliary detergent storage part 476*c* and prevent the wash water of the second tub 410 from flowing backward to the detergent storage part 472*c*.

In some implementations, the detergent water supply pipe 474*c* may be connected to the second tub 410 in a manner of being extended from the detergent storage part 472*c* toward the second water supply part 450*c* (i.e., a rear side of the second wash unit 40) and then bent in a center direction of the second tub 410.

In some other implementations, the detergent water supply pipe 474*c* may be connected to the second tub 410 in a manner of being extended from the detergent storage part 472*c* toward the auxiliary detergent storage part 476*c* and then bent toward a center of the second tub 410.

Similarly, in some implementations, the auxiliary detergent water supply pipe 478*c* may be connected to the second tub 410 in a manner of being extended from the auxiliary detergent storage part 476*c* toward the second water supply part 450*c* (i.e., a rear side of the second wash unit 40) and then bent in a center direction of the second tub 410.

In some other implementations, the auxiliary detergent water supply pipe 478*c* may be connected to the second tub 410 in a manner of being extended from the auxiliary detergent storage part 476*c* toward the detergent storage part 472*c* and then bent toward the center of the second tub 410.

In certain implementations, the detergent water supply pipe 474*c* and the auxiliary detergent water supply pipe 478*c* may be connected to the sidewall of the second tub with an installation direction to achieve an extension line in a direction of passing through a center of the second tub 410, a direction in parallel with an extension line in a direction of passing through a center of the second tub 410, or a direction tangential to the sidewall of the second tub 410.

In certain other implementations, the detergent water supply pipe 474*c* and the auxiliary detergent water supply pipe 478*c* may be connected to the sidewall of the second tub in a symmetric shape centering on the second tub 410 or in a manner of being adjacent to each other or spaced from each other in a prescribed distance.

In some implementations, the detergent water supply pipe 474*c* and the auxiliary detergent water supply pipe 478*c* may be connected to different locations on the sidewall of the second tub 410. Particularly, with reference to a height of the second tub 410 or a center of a height of a sidewall of the second tub, the detergent water supply pipe 474*c* or the auxiliary detergent water supply pipe 478*c* may be located at one of a top end portion, a top portion, a middle portion, a bottom portion and a bottom end portion. In some implementations, the detergent water supply pipe 474*c* and the auxiliary detergent water supply pipe 478*c* may be connected at different locations on the sidewall, respectively.

As to the installation heights of the detergent water supply pipe and the auxiliary detergent water supply pipe, one of the detergent water supply pipe and the auxiliary detergent water supply pipe may be located at the top portion and the other is located at the bottom portion.

Thus, the extended directions and installation locations of the detergent water supply part 474*c* and the auxiliary detergent water supply pipe 478*c* may be selectively formed depending on whether a space between the second tub 410 and the tub case 250 is secured.

As to the connections between the detergent water supply part 474*c* and the auxiliary detergent water supply pipe 478*c* and the sidewall of the second tub 410, it is able to increase the installation degree of freedom of the detergent water supply part 474*c* and the auxiliary detergent water supply pipe 478*c*.

Now, as to the aforementioned second detergent supply part of the fourth implementation of the present disclosure, the detergent supply and the auxiliary detergent supply are described in detail as follows.

First of all, as the laundry treating apparatus 10 is operating, a user may insert a detergent (e.g., liquid detergent, powder detergent, etc.) through the detergent entrance 471*c* of the second detergent supply part 470*c* or an auxiliary detergent (e.g., fabric softener, bleach, etc.) through the auxiliary detergent entrance 475*c*.

The detergent inserted in the detergent entrance 471*c* is stored in the detergent storage part 472*c*. Since the detergent water supply valve 473*c* provided to the detergent water supply pipe 474*c* maintains a closed state, the detergent stored in the detergent storage part 472*c* is prevented from being immediately inserted into the second tub 410.

The auxiliary detergent inserted in the auxiliary detergent entrance 475*c* is stored in the auxiliary detergent storage part 476*c*. Since the auxiliary detergent water supply valve 477*c* provided to the auxiliary detergent water supply pipe 478*c* maintains a closed state, the auxiliary detergent stored in the auxiliary detergent storage part 476*c* is prevented from being immediately inserted into the second tub 410.

As the wash process of the laundry treating apparatus proceeds, wash water is supplied from an external water supply source. The supplied wash water is supplied to the second main water supply pipe 455*c* according to an operation of the second valve assembly 452*c* of the second water supply part 450*c*. The wash water supplied to the second main water supply pipe 455*c* may supply the wash water to the second detergent water supply line 451*c*, the second auxiliary detergent water supply line 453*c* and the second tap water supply line 454*c* diverging from the second main water supply pipe 455*c*.

In this case, as to the wash water supplied from the second detergent water supply line 451*c* and the second auxiliary detergent supply line 453*c*, since the second detergent water supply line 451*c*, the second auxiliary detergent water supply line 453*c* and the second tap water supply line 454*c* are independently controlled by the detergent water supply valve 451*c*' and the auxiliary detergent water supply valve 453*c*', the water supply to the detergent storage part 472*c*, the auxiliary detergent storage part 476*c* and the second tub 410 may be independently controlled.

In some implementations, the wash water supplied to the detergent storage part 472*c* through the second detergent water supply line 451*c* is inserted in the detergent storage part 472*c* and then mixed with a detergent stored in the detergent storage part 472*c*. The wash water mixed with the detergent in the detergent storage part 472*c* can then be supplied to the second tub 410 if the detergent water supply valve 473*c* provided to the detergent water supply pipe 474*c* is opened.

In some implementations, the wash water supplied to the auxiliary detergent storage part 476*c* through the second auxiliary detergent water supply pipe 478*c* is inserted in the auxiliary detergent storage part 476*c* and then mixed with an auxiliary detergent stored in the auxiliary detergent storage part 476*c*. The wash water mixed with the auxiliary detergent in the auxiliary detergent storage part 476*c* can then be supplied to the second tub 410 if the auxiliary detergent water supply valve 477*c* provided to the auxiliary detergent water supply pipe 478*c* is opened.

A fifth implementation of a second wash unit in a laundry treating apparatus according to the present disclosure is described in detail with reference to FIG. 11 as follows.

Figure 11:
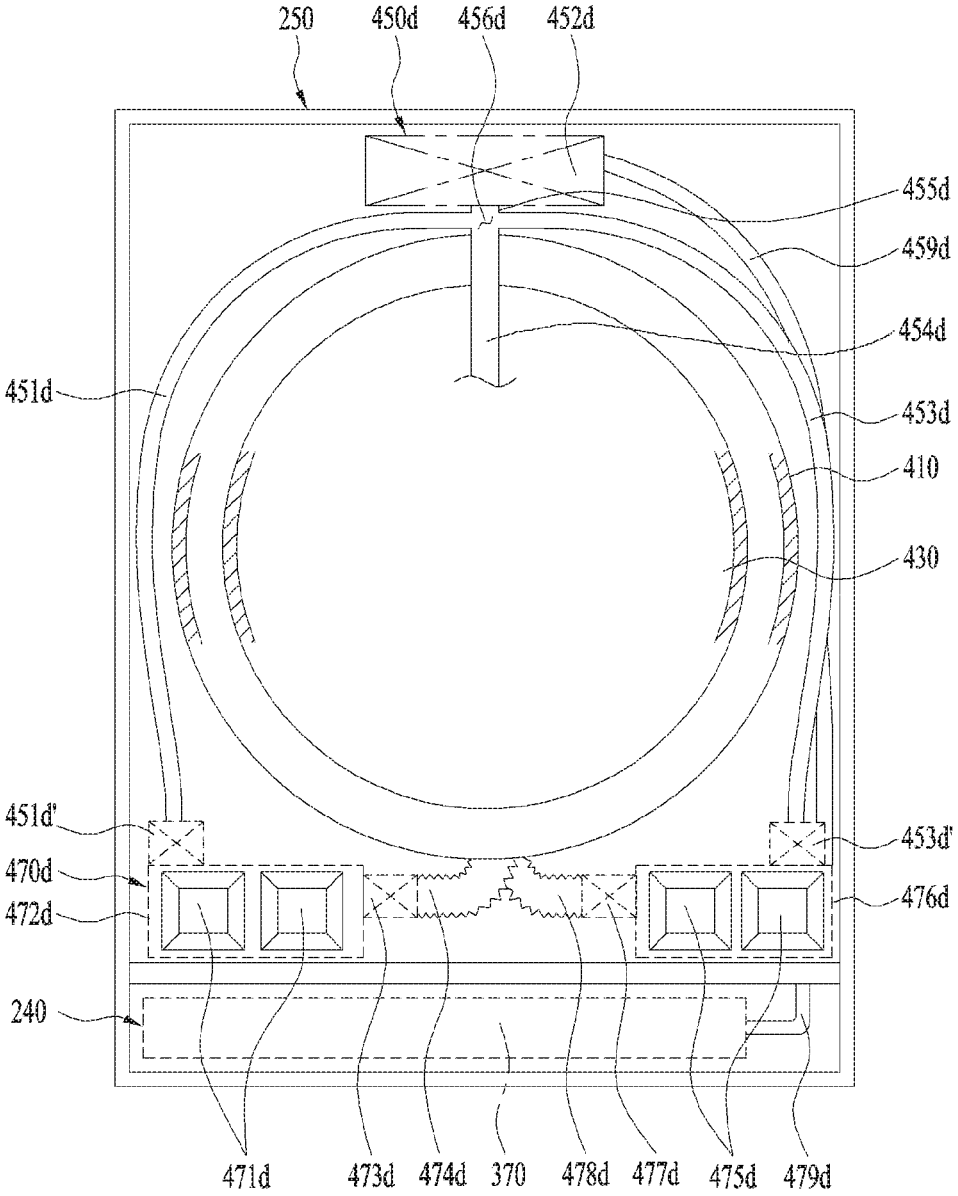

Referring to FIG. 11, a fifth implementation of the present disclosure may include a first detergent supply part 370 supplying a detergent and an auxiliary detergent to the first wash unit 30 and a second detergent supply part 470*d* supplying a detergent and an auxiliary detergent to the second wash unit 40.

In some implementations, the second detergent supply part 470*d* may have the same structure of the aforementioned first implementation. In certain implementations, the first detergent supply part 370 may have the same structure of the second detergent supply part 470*d*.

The first detergent supply part 370 and the second detergent supply part 470*d* are provided to supply detergents and auxiliary detergents to the first wash unit 30 and the second wash unit 40, respectively. For user's convenience, the first detergent supply part 370 and the second detergent supply part 470*d* are located at a front side of the laundry treating device.

The second detergent supply part 470*d* may include a detergent entrance 471*d* provided to one side in front of the second tub 410 in order to insert a detergent (e.g. a liquid detergent or a powder detergent) for a wash of laundry and an auxiliary detergent entrance 475*d* provided to the other side in front of the second tub 410 in order to insert an auxiliary detergent (e.g., fabric softener, bleach, etc.) playing an auxiliary role in washing laundry.

The first detergent supply part 370 is located in front of the second detergent supply part 470*d*. In order to separately supply a detergent and an auxiliary detergent in a manner similar to the second detergent supply part 470*d*, the first detergent supply part 370 has a structure in which a detergent entrance structure and an auxiliary detergent entrance structure are separated from each other.

In some implementations, the first detergent supply part and/or the second detergent supply part may be formed in the tub case 250 to be exposed or may be provided to be open/closed by the tub cover 252 or/and the detergent insertion door 254 provided to the tub case 250.

A detergent storage part 472*d* is provided under the detergent entrance 471*d* of the second detergent supply part 470*d* so as to temporarily store the inserted liquid or powder detergent. An auxiliary detergent storage part 476*d* is provided under the auxiliary detergent entrance 475*d* of the second detergent supply part 470*d* so as to temporarily store the inserted auxiliary detergent.

A second water supply part 450*d* includes a first main water supply pipe 459*d* extended from a second valve assembly 452*d* to the first detergent supply part 370, a second main water supply pipe 455*d* extended from the second valve assembly 452*d* to the second detergent supply part 470*d*, a second detergent water supply line 451*d* connected to the detergent storage part 472*d* by diverging from the second main water supply pipe 455*d*, a second auxiliary detergent water supply line 453*d* connected to the auxiliary detergent storage part 476*d* by diverging from the second main water supply pipe 455*d*, and a second tap water supply line 454*d* diverging from the second main water supply pipe 455*d* to separately supply a wash water to the second tub 410.

The first main water supply pipe 459*d* supplies a wash water to the first detergent supply part 370, whereby a detergent and an auxiliary detergent can be supplied to the first tub 310 through the first detergent supply part 370.

The second detergent water supply line 451*d*, the second auxiliary detergent water supply line 453*d*, and the second tap water supply line 454*d* diverge from a specific diverging part 456*d* of the second main water supply pipe 455*d* so as to supply wash water to the detergent storage part 472*d*, the auxiliary detergent storage part 476*d* and the second tub 410, respectively.

In this case, wash water can be simultaneously supplied to the second detergent water supply line 451*d*, the second auxiliary detergent water supply line 453*d*, and the second tap water supply line 454*d* through the second main water supply pipe 455*d*.

In some implementations, the second detergent water supply line 451*d* and the second auxiliary detergent water supply line 453*d* may be further provided with a separate detergent water supply valve 451*d*' and a separate auxiliary detergent water supply valve 453*d*' for the water supply control independent from the second tap water supply line, respectively. Therefore, the second tap water supply line 454*d* may supply wash water to the second tub 410 independently from the second detergent water supply line 451*d* or the second auxiliary detergent water supply line 453*d*. The second tap water supply line 454*d* may supply the wash water to the second tub 410 by being directly connected to the second tub 410. Alternatively, the second tap water supply line 454*d* is connected to the tub door 413 provided to the second tub 410, thereby spreading to supply the wash water into the second tub 410 from a top of the second tub 410.

Under the detergent entrance 471*d*, the detergent storage part 472*d* for temporarily storing the inserted detergent is provided. The second detergent water supply line 451*d* extended from the second valve assembly 452*d* is connected to the detergent storage part 472*d*. The liquid or powder detergent inserted in the detergent storage part 472*d* may be mixed with the wash water supplied from the second detergent water supply line 451*d* and then supplied to the second tub 410.

Under the detergent storage part 472*d*, a detergent water supply pipe 474*d* is provided to supply the detergent and wash water mixed in the detergent storage part 472*d* to the second tub 410. The detergent supply water pipe 474*d* may be configured in a bellows shape to prevent vibration from being transferred to the second tub 410 on rotating the second drum 430.

A detergent water supply valve 473*d* is provided to the detergent water supply pipe 474*d*, thereby controlling the supply of the detergent and wash water mixed in the detergent storage part 472*d*. The detergent water supply valve 473*d* is provided between the detergent water supply pipe 474*d* and the detergent storage part 472*d*, thereby controlling the supply of the detergent and wash water of the detergent storage part 472*d* and preventing the wash water of the second tub 410 from flowing backward to the detergent storage part 472*d*.

In some operating conditions, as to the second tub 410, it may occur that the wash water flows backward to the detergent storage part 472*d* through the detergent water supply pipe 474*d* connected to the second tub 410 by centrifugal force of the second drum 430 rotated within the second tub 410. Therefore, when the second drum 430 is rotated, the detergent water supply valve 473*d* closes the detergent water supply pipe 474*d* so as to prevent the wash water of the second tub 410 from flowing backward through the detergent water supply pipe 474*d* due to the centrifugal force.

Under the auxiliary detergent storage part 476*d*, an auxiliary detergent water supply pipe 478*d* is provided so as to supply the auxiliary detergent (e.g. fabric softener) and wash water mixed in the auxiliary detergent storage part 476*d* to the second tub 410. The auxiliary detergent supply water pipe 478*d* may be configured in a bellows shape to prevent vibration from being transferred to the second tub 410 on rotating the second drum 430.

The auxiliary detergent supply water pipe 478*d* is provided with an auxiliary detergent water supply valve 477*d* configured to control the supply of the auxiliary detergent (e.g. fabric softener) and wash water mixed in the auxiliary detergent storage part 476*d*. The auxiliary detergent water supply valve 477*d* is provided between the auxiliary detergent water supply pipe 478*d* and the auxiliary detergent storage part 476*d*, thereby controlling the supply of the auxiliary detergent of the auxiliary detergent storage part 476*d* and preventing the wash water of the second tub 410 from flowing backward to the auxiliary detergent storage part 476*d*.

In some operating conditions, as to the second tub 410, it may occur that the wash water flows backward to the auxiliary detergent storage part 476*d* through the auxiliary detergent water supply pipe 478*d* connected to the second tub 410 by centrifugal force of the second drum 430 rotated within the second tub 410. Therefore, when the second drum 430 is rotated, the auxiliary detergent water supply valve 477*d* closes the auxiliary detergent water supply pipe 478*d* so as to prevent the wash water of the second tub 410 from flowing backward through the auxiliary detergent water supply pipe 478*d* due to the centrifugal force.

In some implementations, the auxiliary detergent water supply valve 477*d* can control the supply of the detergent and wash water of the auxiliary detergent storage part 476*d* and prevent the wash water of the second tub 410 from flowing backward to the detergent storage part 472*d*.

Now, as to the aforementioned second detergent supply part of the fifth implementation of the present disclosure, the detergent supply and the auxiliary detergent supply are described in detail as follows.

First of all, as the laundry treating apparatus 10 is operating, a user may insert a detergent (e.g., liquid detergent, powder detergent, etc.) through the detergent entrance 471*d* of the second detergent supply part 470*c* or an auxiliary detergent (e.g., fabric softener, bleach, etc.) through the auxiliary detergent entrance 475*d*.

The detergent and auxiliary detergent inserted in the first detergent supply part 370 may be supplied to the first tub 310 of the first wash unit 30 by wash water supplied from the first main water supply pipe 459*d* of the second water supply part 450*d*.

On the other hand, the detergent inserted in the detergent entrance 471*d* of the second detergent supply part 470*d* is stored in the detergent storage part 472*d*. Since the detergent water supply valve 473*d* provided to the detergent water supply pipe 474*d* maintains a closed state, the detergent stored in the detergent storage part 472*d* is prevented from being immediately inserted into the second tub 410.

The auxiliary detergent inserted in the auxiliary detergent entrance 475*d* is stored in the auxiliary detergent storage part 476*d*. Since the auxiliary detergent water supply valve 477*d* provided to the auxiliary detergent water supply pipe 478*d* maintains a closed state, the auxiliary detergent stored in the auxiliary detergent storage part 476*d* is prevented from being immediately inserted into the second tub 410.

As the wash process of the laundry treating apparatus 10 proceeds, wash water is supplied from an external water supply source. The supplied wash water is supplied to the second main water supply pipe 455*d* according to an operation of the second valve assembly 452*d* of the second water supply part 450*d*. The wash water supplied to the second main water supply pipe 455*d* may supply the wash water to the second detergent water supply line 451*d*, the second auxiliary detergent water supply line 453*d* and the second tap water supply line 454*d* diverging from the second main water supply pipe 455*d*.

In this case, as to the wash water supplied from the second detergent water supply line 451*d* and the second auxiliary detergent supply line 453*d*, since the second detergent water supply line 451*d*, the second auxiliary detergent water supply line 453*d* and the second tap water supply line 454*d* are independently controlled by the detergent water supply valve 451*d'* and the auxiliary detergent water supply valve 453*d'*, the water supply to the detergent storage part 472*d*, the auxiliary detergent storage part 476*d* and the second tub 410 may be independently controlled.

In some implementations, the wash water supplied to the detergent storage part 472*d* through the second detergent water supply line 451*d* is inserted in the detergent storage part 472*d* and then mixed with a detergent stored in the detergent storage part 472*d*. The wash water mixed with the detergent in the detergent storage part 472*d* can then be supplied to the second tub 410 if the detergent water supply valve 473*d* provided to the detergent water supply pipe 474*d* is opened.

In some implementations, the wash water supplied to the auxiliary detergent storage part 476*d* through the second auxiliary detergent water supply pipe 478*d* is inserted in the auxiliary detergent storage part 476*d* and then mixed with an auxiliary detergent stored in the auxiliary detergent storage part 476*d*. The wash water mixed with the auxiliary detergent in the auxiliary detergent storage part 476*d* can then be supplied to the second tub 410 if the auxiliary detergent water supply valve 477*d* provided to the auxiliary detergent water supply pipe 478*d* is opened.

FIG. 12 is a table showing an operation of each valve in response to an operation of a second wash unit in a laundry treating apparatus according to the present disclosure. The operation states of the valves provided to the second water supply part 450*d* and the second detergent supply part 470*d* are described in detail with reference to FIG. 12. In describing an operation state of a valve, the following description is made on the basis of the fifth implementation described with reference to FIG. 11. Hence, the following description may be understood by referring to FIG. 11.

Referring to FIG. 11 and FIG. 12, the second water supply part 450*a* and the second detergent supply part 470*a* are configured to selectively insert a detergent and an auxiliary detergent in a washing cycle, a rinsing cycle, or a dewatering cycle of a wash process of the second wash unit 40.

Typically, a detergent is mainly inserted to raise the efficacy in washing of a laundry. An auxiliary detergent (e.g., fabric softener, bleach, etc.) is typically inserted to provide additional effects and functions to a laundry in the rinsing cycle. In the dewatering cycle, the supply of the wash water, detergent and auxiliary detergent is stopped. Therefore, a detergent inserting step of the washing cycle, an auxiliary detergent inserting step of the rinsing cycle, and an operation of the dewatering cycle in the second wash unit 40 are described as an example.

First of all, in the washing cycle of the second wash unit 40, a detergent may be supplied to wash laundry and the supply of an auxiliary detergent may be stopped. Hence, in the washing cycle, the second detergent water supply pipe 474*d* of the second valve assembly 452*d* is turned on (or opened), wash water is supplied to the detergent storage part 472*d*. Simultaneously, since the detergent water supply pipe 474*d* is turned on by the detergent water supply valve 473*d*, a detergent of the detergent storage part 472*d* can be supplied to the second tub 410 together with the wash water.

As to the second detergent water supply line 451*d* by the second valve assembly 452*d* and the detergent water supply pipe 474*d* by the detergent water supply valve 451*d*', the second valve assembly 452*d* and the detergent water supply valve 451*d*' are maintained in ON (OPEN) state and tap water and wash water are supplied to the second tub 410 through the second detergent water supply line 451*d* and the detergent water supply pipe 474*d*.

On the other hand, since a supply of an auxiliary detergent is unnecessary, the second auxiliary detergent water supply line 453*d* by the second valve assembly 452*d* and the auxiliary detergent water supply pipe 478*d* by the auxiliary detergent water supply valve 453*d*' are maintained in OFF (CLOSE) state, thereby cutting off the auxiliary detergent supplied through the auxiliary detergent water supply pipe 478*d*.

In the rinsing cycle of the second wash unit 40, it may be necessary to supply a tap water and an auxiliary detergent to rinse the laundry. Therefore, in the rinsing cycle, the second detergent water supply pipe 474*d* and/or the second tap water supply line 454*d* of the second valve assembly 452*d* are turned on (or opened), thereby supplying the tap water to the detergent storage part 472*d* and/or the second tub 410. Simultaneously, as the auxiliary detergent water supply pipe 478*d* is turned on by the auxiliary detergent water supply valve 453*d*', the auxiliary detergent of the auxiliary detergent storage part 476*d* and the wash water can be supplied to the second tub 410.

During the rinsing cycle, the second detergent water supply line 451*d* and the detergent water supply line 474*d* maintain the ON state for the supply of tap water, and the second auxiliary detergent water supply line 453*d* and the auxiliary detergent water supply line 478*d* maintain the ON state for the supply of auxiliary detergent.

In the dewatering cycle, the washing cycle or the rinsing cycle, if the second drum 430 is rotated, the detergent water supply valve 473*d* provided to the detergent water supply pipe 474*d* and the auxiliary detergent water supply valve 477*d* provided to the auxiliary detergent water supply pipe 478*d* always maintain the OFF state.

In some operating conditions, when the second drum 430 is rotated, the wash water supplied to the second tub 410 is rotated as well. In order to prevent the wash water supplied to the second tub 410 from flowing backward toward the detergent water supply pipe 474*d* and the auxiliary detergent water supply pipe 478*d* due to centrifugal force, the detergent water supply valve 473*d* and the auxiliary detergent water supply valve 477*d* maintain the OFF state when the second drum 430 is rotated.

In some implementations, the second water supply part 450 (450*a* to 450*d*), the second detergent supply part 470 (470*a* to 470*d*), and the controller 50 may be located in a space formed by the second tub 410 and the edges of the tub case 250.

In some implementations, as to an outer circumference of the second tub 410 formed in the cylindrical shape and inner circumference edges of the tub case 250 formed in the rectangular shape, a largest space may be formed between the second tub 410 and an inside of the tub case 250, whereby the installation space for the second water supply part 450 (450*a* to 450*d*), the second detergent supply part 470 (470*a* to 470*d*), and the controller 50 may be sufficiently secured.

In some implementations, although the second detergent supply part 470 (470*a* to 470*d*) is described as exposed or shielded according to an opening/closing of the detergent insertion door 254 provided to the tub case 250, it may be provided as always exposed without a separate structure of the detergent insertion door 254. In some other implementations, as the second detergent supply part 470 (470*a* to 470*d*) is located under the tub cover 252 formed in the tub case 250, it may be provided as exposed or shielded together with the second entrance 253, through which laundry is inserted, according to an opening/closing of the tub cover 252.

It will be understood that various modifications may be made without departing from the spirit and scope of the claims. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A laundry treating apparatus, comprising:

a housing;

a first wash unit within the housing, the first wash unit comprising a first tub, a first drum mounted inside the first tub, and a first drive unit configured to drive a rotation of the first drum within the first tub;

a second wash unit within the housing, the second wash unit comprising a second tub, a second drum mounted inside the second tub, and a second drive unit configured to drive a rotation of the second drum within the second tub;

a valve assembly that is configured to receive tap water and that is configured to control a supply of the tap water to each of the first wash unit and the second wash unit within the housing; and at least two supply lines configured to supply the tap water from the valve assembly to at least two supply points of the second tub in the second wash unit, wherein the at least two supply lines comprise:

a first detergent water supply line that extends toward a first detergent storage part located between the housing and the second tub, a second detergent water supply line that extends toward a second detergent storage part located between the housing and the second tub, a first detergent water supply pipe that connects the first detergent storage part to a sidewall of the second tub, and a second detergent water supply pipe that connects the second detergent storage part to the sidewall of the second tub, and wherein the first detergent water supply line and the second detergent water supply line are branched from a main water supply pipe that extends from the valve assembly.

2. The apparatus of claim 1, wherein the at least two supply lines further comprise:

a tap water supply line configured to supply, to the second tub, tap water without detergent.

3. The apparatus of claim 2, wherein:

the second wash unit is a top loading type, the second tub comprises:

a top portion defining an upward opening through which an inside of the second tub is accessible;

a bottom portion fixing the second drive unit and having a perforated hole connecting the second drum and the second drive unit to each other; and a sidewall connecting the top portion and the bottom portion in a cylindrical shape, wherein a diameter of the bottom portion of the second tub is greater than a height of the sidewall of the second tub.

4. The apparatus of claim 3, wherein the tap water supply line is configured to supply the tap water through the opening of the top portion of the second tub.

5. The apparatus of claim 1, wherein the second tub is a top loading type, and wherein the first detergent water supply pipe and the second detergent water supply pipe are connected and distributed to the at least two supply points of the second tub.

6. The apparatus of claim 5, further comprising a detergent water supply valve located at the first detergent water supply pipe between the first detergent storage part and the second tub.

7. The apparatus of claim 6, wherein the detergent water supply valve comprises a check valve configured to control a unidirectional flow of detergent water toward the second tub.

8. The apparatus of claim 6, wherein the detergent water supply valve comprises an electronic valve configured to be controlled to interoperate with the valve assembly by at least one processor.

9. The apparatus of claim 6, wherein, during supply of tap water, the detergent water supply valve is turned on and controls a supply of detergent water to the second tub through the first detergent water supply pipe and wherein, based on a washing, rinsing, or dewatering cycle being in progress through the first detergent water supply pipe in a state that a supply of tap water is stopped, the detergent water supply valve is turned off to block wash water in the second tub from flowing backward to the first detergent storage part through the first detergent water supply pipe.

10. The apparatus of claim 5, wherein the first detergent water supply pipe is configured to communicate with an inside of the second tub by perforating the sidewall of the second tub.

11. The apparatus of claim 5, wherein the first detergent water supply pipe and the second detergent water supply pipe are configured in a manner in which a connection to the second tub is distributed into several points.

12. The apparatus of claim 5, wherein the first detergent water supply pipe communicates with the sidewall at a first location, and the second detergent water supply pipe communicates with the sidewall at a second location that is spaced apart from the first location.

13. The apparatus of claim 1, wherein the second detergent water supply pipe comprises a bleach line configured to supply bleach to the second tub.

14. The apparatus of claim 1, wherein the first detergent water supply line is configured to supply detergent to the second tub, and the second detergent water supply line is configured to supply fabric softener to the second tub.

15. The apparatus of claim 14, wherein the second detergent storage part comprises a plurality of detergent storage parts configured to supply bleach.

16. The apparatus of claim 1, wherein the first detergent water supply pipe and the second detergent water supply pipe are configured to separately supply detergent and fabric softener, respectively, and the second detergent storage part is configured to store the fabric softener, and wherein the apparatus further comprises an electronic valve that is configured to cut off the tap water and that is located between the second detergent water supply line and the second detergent storage part.

17. The apparatus of claim 16, wherein the electronic valve is controlled to be turned on for a portion of a time needed to control the valve assembly to be turned on so that the tap water supplies the fabric softener to the second tub through the second detergent storage part.

18. The apparatus of claim 17, wherein, while the electronic valve is controlled to be turned on, a water supply valve on the second detergent water supply pipe between the second detergent storage part and the second tub is controlled to be turned on.

19. The apparatus of claim 18, wherein the water supply valve on the second detergent water supply pipe comprises a check valve and wherein, based on the electronic valve being turned on, the water supply valve is open by a flow pressure so that the fabric softener is supplied into the second tub.

20. The apparatus of claim 3, wherein the tap water supply line is configured to be turned off by a control of the valve assembly, wherein the tap water supply line is configured to supply the tap water toward the opening of the top portion of the second tub from the valve assembly, and wherein the tap water supply line is connected to the main water supply pipe of the valve assembly and to at least one of the first detergent water supply line or the second detergent water supply line.

21. The apparatus of claim 3, wherein the tap water supply line is configured to be turned off by a control of the valve assembly, wherein the tap water supply line is configured to supply the tap water toward the opening of the top portion of the second tub from the valve assembly, and wherein the tap water supply line is connected to the first detergent water supply line and the second detergent water supply line.

22. The apparatus of claim 3, wherein the tap water supply line is configured to supply the tap water through the opening of the top portion of the second tub, and wherein the first and second detergent water supply lines are branched from a point between the valve assembly and the tap water supply line, communicate with a plurality of points on the sidewall of the second tub through the first and second detergent storage parts and the first and second detergent water supply pipes, respectively, and separately supply a detergent and a fabric softener to the second tub.

23. The apparatus of claim 1, wherein each of the first detergent water supply line and the second detergent water supply line surrounds at least a portion of an outer circumference of the second tub.

24. The apparatus of claim 2, wherein the tap water supply line is branched at a point downstream of the valve assembly into the first detergent water supply line and the second detergent water supply line.

* * * * *